US012234998B1

(12) United States Patent
Fratianne

(10) Patent No.: US 12,234,998 B1
(45) **Date of Patent: *Feb. 25, 2025**

(54) TAMPER-RESISTANT BASEBOARD HEATER COVER ASSEMBLY

(71) Applicant: Gary Fratianne, Avon Lake, OH (US)

(72) Inventor: Gary Fratianne, Avon Lake, OH (US)

(73) Assignee: Gary Fratianne, Avon Lake, OH (US)

( * ) Notice: Subject to any disclaimer, the term of this patent is extended or adjusted under 35 U.S.C. 154(b) by 733 days.

This patent is subject to a terminal disclaimer.

(21) Appl. No.: 17/533,956

(22) Filed: Nov. 23, 2021

Related U.S. Application Data

(62) Division of application No. 15/282,154, filed on Sep. 30, 2016, now abandoned.

(60) Provisional application No. 62/248,564, filed on Oct. 30, 2015, provisional application No. 62/234,925, filed on Sep. 30, 2015, provisional application No. 62/234,936, filed on Sep. 30, 2015.

(51) Int. Cl.
*F24D 19/04* (2006.01)
*F24D 19/06* (2006.01)

(52) U.S. Cl.
CPC ..... *F24D 19/04* (2013.01); *F24D 19/06* (2013.01)

(58) Field of Classification Search
CPC ..... F24D 19/04; F24D 19/06; F24D 19/061; F24D 19/062; F24D 19/065; F24D 19/067; F24D 19/068; F24D 19/064
USPC ..... 219/200, 209, 213, 225, 226, 242, 254, 219/259, 385
See application file for complete search history.

(56) References Cited

U.S. PATENT DOCUMENTS

| | | | |
|---|---|---|---|
| 2,993,978 | A | 7/1961 | Markel et al. |
| 4,157,731 | A | 6/1979 | Denhart |
| 6,889,911 | B2 | 5/2005 | Uglietto et al. |
| 7,089,707 | B2 | 8/2006 | Uglietto et al. |
| 10,222,074 | B2 | 3/2019 | Marino et al. |
| 2003/0155099 | A1 | 8/2003 | William, Jr. |
| 2003/0155100 | A1 | 8/2003 | William, Jr. |
| 2007/0175124 | A1 | 8/2007 | Webster |
| 2009/0294210 | A1 | 12/2009 | Bohnaker et al. |

FOREIGN PATENT DOCUMENTS

DE 29713326 U1 7/1997

OTHER PUBLICATIONS

Buss, Jon, Baseboarders—The Easy Slip-on Baseboard Heater Cover, Oct. 3, 2013, YouTube https://www.youtube.com/watch?v=KxvwQlbXWXA.
Screenshots of webpage from https://www.baseboardheatercovers.com, printed Sep. 30, 2016.

*Primary Examiner* — Phuong T Nguyen
(74) *Attorney, Agent, or Firm* — Lippes Mathias LLP

(57) ABSTRACT

The present disclosure relates to a tamper-resistant heater cover assembly for baseboard heater units and components thereof. The components include tamper-resistant end caps, couplers, and corner pieces that can be used with baseboard heating units. The end cap, the coupler, and corner piece contain apertures and flanges adapted to accommodate one or more fasteners for attaching the end cap coupler, or corner piece to a wall.

10 Claims, 20 Drawing Sheets

TAMPER-RESISTANT BASEBOARD HEATER COVER ASSEMBLY

CROSS-REFERENCE TO RELATED APPLICATIONS

This application is a divisional of U.S. patent application Ser. No. 15/282,154, filed Sep. 30, 2016, which claims priority to U.S. Provisional Patent Application Ser. No. 62/248,564, filed on Oct. 30, 2015; and to U.S. Provisional Patent Application Ser. No. 62/234,925, filed on Sep. 30, 2015; and to U.S. Provisional Patent Application Ser. No. 62/234,936, filed on Sep. 30, 2015, the disclosures of which are hereby fully incorporated by reference in their entireties.

BACKGROUND

The present disclosure is directed to covers for baseboard heating units. More particularly, it is directed to a tamper-resistant heater cover assembly for baseboard heater units and components thereof. More specifically, end caps and couplers for use in a tamper-resistant heater cover assembly are disclosed. Tamper-resistant baseboard heater cover corner pieces adapted to mate with associated baseboard heater cover panels are also disclosed.

Baseboard heaters are typically long low profile units that run along the base of a wall and are used to provide heat in living spaces. A typical baseboard heater is a housing associated with a heating element contained in the housing, such as a resistive heating element or a fluid heating element. Alternatively, the housing can direct forced air from a furnace into the living space.

The housings of many existing baseboard heating units are old and are undesirably styled, rusted, dented, or generally unattractive. Many baseboard heater covers are also made of valuable metal that can be removed and subsequently scrapped for money. In addition, baseboard heating units, especially those with electric heating elements, are vulnerable to rewiring. For example, the tenants of one apartment could rewire their electric baseboard heater units to use electricity supplied by another apartment, thus escaping a higher electric bill. Furthermore, baseboard heaters generally contain an internal volume that is vulnerable to the insertion of foreign objects, such as money, contraband, or fingers/toes.

It would be desirable to provide a baseboard heater cover that could reduce the occurrence of such events, provide a pleasing aesthetic appearance, and be resistant to tampering.

SUMMARY OF THE DISCLOSURE

The present disclosure relates to tamper-resistant end caps, couplers, and corner pieces that can be used in a tamper-resistant heater cover assembly. Generally, the end caps, couplers, and corner pieces contain additional apertures that permit them to be placed for use on a baseboard heating unit, and then be secured to the wall to deter tampering with the heating unit.

Disclosed in various embodiments are end caps for a heater cover assembly. The end caps include a closed face comprising an interior surface and exterior surface. An open face opposite the closed face accommodates the insertion of an associated heater cover panel. The open face gives access to the interior volume of the end cap. A top face is present. A front face comprises an interior surface and an exterior surface. A retainer fixed to the interior surface of the front face and is adapted to hold an associated heater cover panel in place. A rear face is also present. A top aperture is positioned along a top edge of the rear face. At least one bottom aperture is positioned along a bottom edge of the rear face, which is adapted to accommodate a fastener for attaching the end cap to a wall. A front hole is present along a bottom edge of the front face, and is adapted to provide an opening through which a tool can access the at least one bottom aperture on the bottom edge of the rear face.

The front hole may be larger than the bottom aperture. The rear face may contain a plurality of bottom apertures. The end cap may further comprise a plug for filling the front hole. A cutout may be present in the closed face. The rear face can be formed from two strips, positioned adjacent the top face and the closed face. The front face may comprise an angled surface and a vertical surface.

Also disclosed herein are couplers for joining together heater cover panels. The couplers include a top face having a top front edge and a top rear edge. A front face is connected to the top face along the top front edge, and has a bottom front edge. A bottom face is connected to the front face along the bottom front edge. A rear face hangs down from the top rear edge. Either (a) the rear face includes at least one rear face aperture located along a bottom edge that can accommodate an associated fastener for attachment to a wall; or (b) the bottom face further comprises a tab extending downwards from a rear edge of the bottom face, the tab containing at least one aperture that can accommodate an associated fastener for attachment to a wall. Without a fastener, the bottom face and the rear face are not connected together. A first open side face and a second open side face are also present, which can each accommodate the insertion of an associated heater cover panel.

In some embodiments, the rear face extends downwards beyond the bottom face. In additional embodiments, both options (a) and (b) are included in the coupler. In such embodiments, the tab may contain a plurality of apertures, each being aligned with a different rear face aperture. In some embodiments, the tab extends beyond both side faces.

The front face of the coupler can comprise an angled surface and a vertical surface.

In some embodiments, the bottom edge of the rear face is formed from two vertical strips that each terminate in a flange, the at least one rear face aperture being located in one of the flanges. An opening may be located between the two vertical strips.

In other embodiments, the bottom edge of the rear face terminates in a flange, the at least one rear face aperture being located in the flange.

Also disclosed herein are heater cover assemblies for covering a baseboard heater, comprising: a first end cap and a second end cap; and a first heater cover panel having a first panel end and a second panel end; wherein the first panel end is inserted into the open face of the first end cap and held in place by the fixed retainer on the interior surface of the front face. The end caps have the structures described above.

The second panel end can be inserted into the open face of the second end cap and held in place by the fixed retainer on the interior surface of the front face of the second end cap.

The assembly sometimes further comprises a coupler and a second heater cover panel. The coupler is used to disguise the location where the two heater cover panels meet.

The first heater cover panel, the first end cap, and the second end cap can be made of galvanized steel. The first heater cover panel may contain vents.

Also disclosed herein are corner pieces for a heater cover assembly. The corner pieces comprise a top face, a front face, two rear faces, a bottom face, and two open side faces. The two open side faces are adapted to receive associated baseboard heater cover panels, which are then secured by the corner piece to the wall.

The top face has a front edge, a first side edge, a second side edge, a first rear edge, and a second rear edge. Generally, the first and second rear edges meet at a rear corner. The first side edge and the first rear edge meet at a first side corner. The second side edge and the second rear edge meet at a second side corner. In this way, the top face has five sides. The top face can also have a lip extending downwardly from at least one of the first rear edge and the second rear edge. The lip of the top face can include at least one aperture.

The aperture may be of any suitable size or shape and is generally adapted to accommodate an associated fastener for securing the baseboard heater cover to an associated wall once installed.

The bottom face extends from a bottom edge of the front face, such that at least a portion of the bottom face is below the top face once installed. The bottom face has a lip at a distal edge of the bottom face. The lip extends downwardly from the distal edge and has at least one aperture. The aperture in the lip of the bottom face may be of any suitable size or shape and is generally adapted to accommodate an associated fastener for securing the baseboard heater cover to an associated wall once installed.

In some particular embodiments, the bottom face has first and second leg portions extending from the bottom edge of the front face. Generally, the first and second leg portions generally extend in different directions such that they are at an angle relative to one another. In other embodiments, the bottom face extends from the bottom edge of the front face to the one or more rear faces, such that the bottom face is closed, thereby covering the entirety of the area between the one or more rear faces and the front face.

In certain embodiments, the rear face can include at least two finger portions extending from a common one of the first side edge or the second side edge of the top face, such that at least one of the first rear face and the second rear face includes at least two finger portions. A rear face finger portion connector can be used to interconnect the at least two finger portions of the rear face.

The side faces are open and are adapted to receive a portion of an associated cover piece.

These and other non-limiting aspects of the disclosure are discussed further below.

BRIEF DESCRIPTION OF THE DRAWINGS

The following is a brief description of the drawings, which are presented for the purposes of illustrating embodiments disclosed herein and not for the purposes of limiting the same.

FIG. 5A is a side view of the closed face, showing the cutout. FIG. 5B is a rear view. FIG. 5C is a perspective view of the open face. FIG. 5D is a side view of the open face, showing the interior of the end cap.

FIG. 7A is a first side perspective view. FIG. 7B is a front view. FIG. 7C is a second side perspective view.

FIG. 9A is a side view. FIG. 9B is a front view. FIG. 9C is a top perspective view.

DETAILED DESCRIPTION

Figure 1:
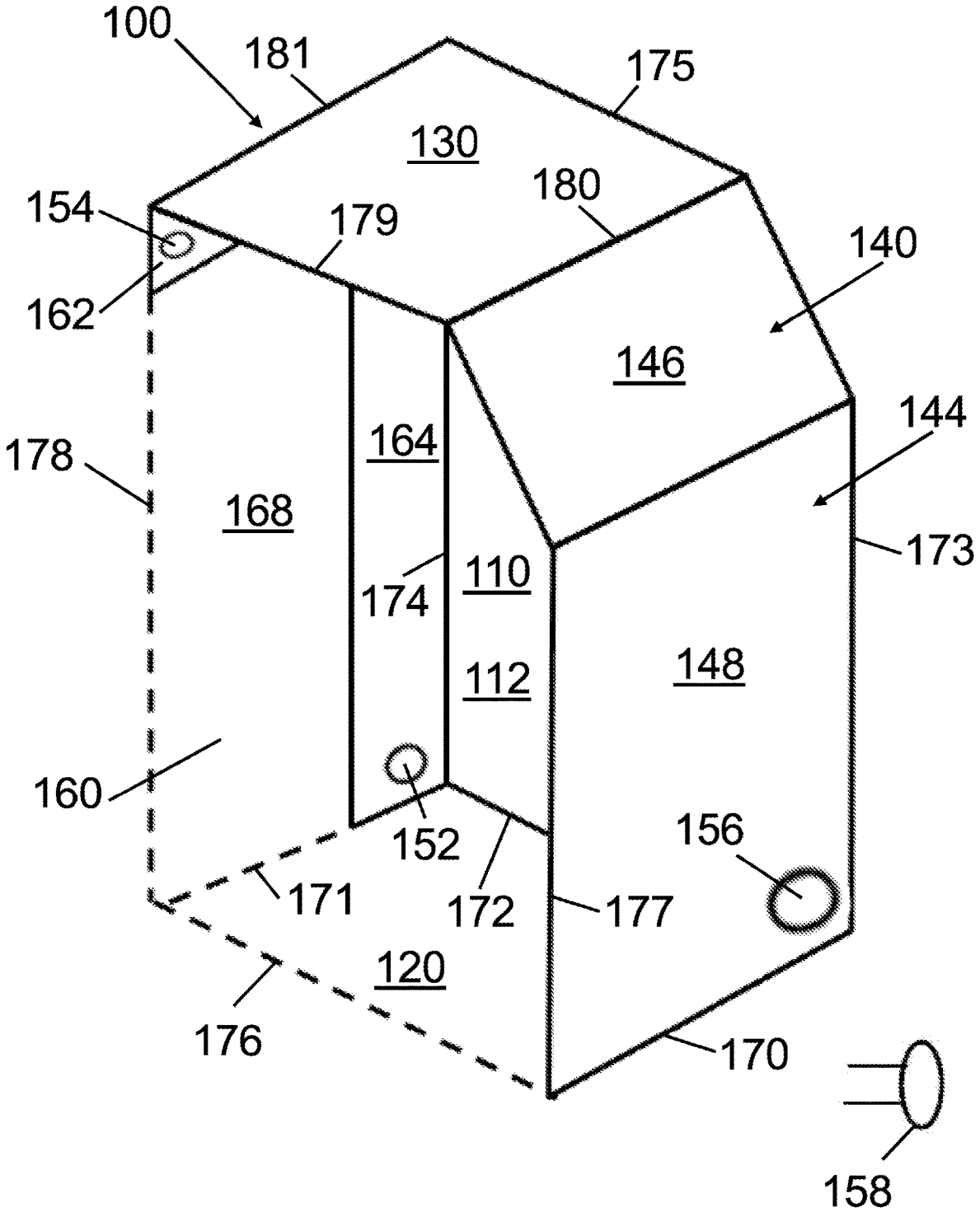
FIG. 1 is a front perspective view of an end cap according to one embodiment of the present disclosure.

A more complete understanding of the devices and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases that require the presence of the named components/parts and permit the presence of other components/parts. However, such description should be construed as also describing devices "consisting of" and "consisting essentially of" the enumerated components/parts, which allows the presence of only the named components/parts and excludes other components/parts.

All ranges disclosed herein are inclusive of the recited endpoint and independently combinable (for example, the range of "from 2 watts to 10 watts" is inclusive of the endpoints, 2 watts and 10 watts, and all the intermediate values). Numerical values should be understood to include numerical values which are the same when reduced to the same number of significant figures and numerical values which differ from the stated value by less than the experimental error of conventional measurement technique of the type described in the present application to determine the value.

As used herein, approximating language may be applied to modify any quantitative representation that may vary without resulting in a change in the basic function to which it is related. Accordingly, a value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1.

Some of the terms used herein are relative terms. For example, the terms "front" and "rear" and "side" are relative to a center, with the front being spaced apart from and in the opposite direction of the rear, and opposite sides being spaced apart from each other along an axis normal to the axis from front to rear. "Top" and "bottom" are also relative terms. As used herein, the front and rear are located along an x-axis, the left and right are located along a y-axis, and the top and bottom are located along a z-axis, wherein the three axes are perpendicular to each other.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other. The terms "upward" and "downward" are also relative to an absolute reference, i.e. the surface of the earth. Put another way, an element that extends "upward" always extends away from the surface of the earth, opposite an element that extends "downward" toward the surface of the earth.

The term "parallel" should be construed in its lay term as two edges or faces generally continuously having the same distance between them, and should not be strictly construed in mathematical terms as requiring that the two edges or faces cannot intersect when extended for an infinite distance. Similarly, the term "perpendicular" should not be construed as requiring that two faces meet at an angle of absolutely 90°.

The present disclosure relates to tamper-resistant end caps, couplers, and corner pieces for a baseboard heater cover assembly. These prevent baseboard heaters from being quickly or easily damaged, stolen, or otherwise tampered with compared to current designs. The devices described herein can be used in combination with any baseboard heater, e.g. baseboard heaters having a resistive heating element or a fluid heating element. It is further contemplated that the present devices can be used wherever it is desirable to protect baseboard heaters, air vents, or the like. The present devices address the shortcomings of prior devices.

Figure 2:
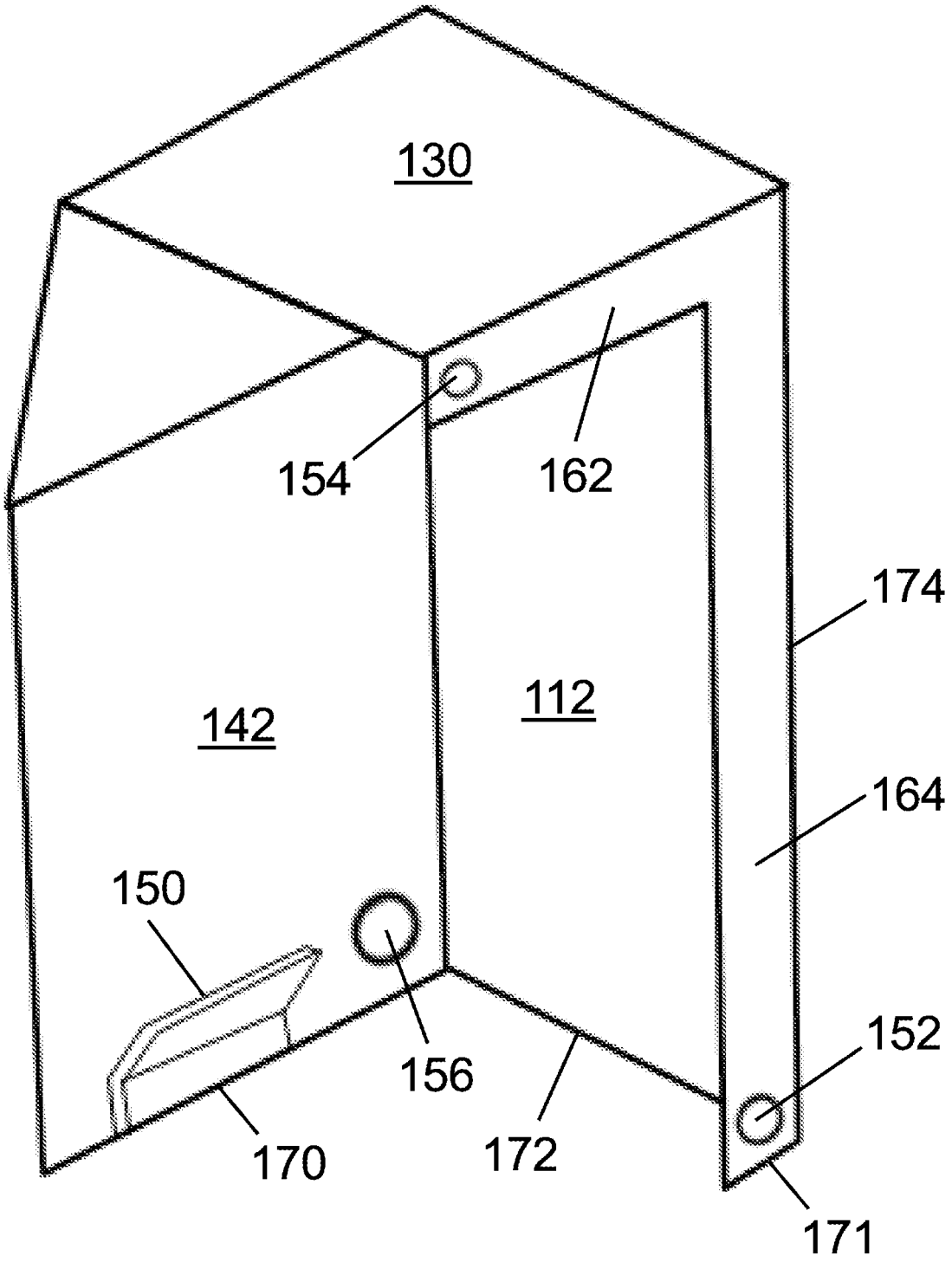
FIG. 2 is a rear perspective view of another end cap.

FIG. 1 and FIG. 2 illustrate different views of an end cap 100 for a heater cover assembly. The end cap is formed from a closed face 110, an open face 120, a top face 130, a front face 140, and a rear face 160. The bottom of the end cap is open.

The closed face 110 has an interior surface 112 and an exterior surface (not visible), and can be considered a first side of the end cap. The perimeter of the closed face is formed from a first top side edge 175, a first rear side edge 174, a first front side edge 173, and a first bottom side edge 172.

The open face 120 is on the other side of the end cap opposite the closed face 110, and can be considered a second side of the end cap. The open face gives access to the interior volume of the end cap and accommodates the insertion of a heater cover panel, as will be described further herein. The perimeter of the open face is formed from a second top side edge 179, a second rear side edge 178, a second front side edge 177, and a second bottom side edge 176.

The top face 130 is generally solid, i.e. has no holes or vents. The perimeter of the top face is formed from a top front edge 180, a top rear edge 181, a first top side edge 175, and a second top side edge 179.

As illustrated here, the front face 140 is made of an upper surface 146 and a lower surface 148, with the lower surface being vertical and the upper surface being angled relative to the lower surface. The design of the front face 140 can contain one surface or multiple surfaces, based upon design preferences. The perimeter of the front face is formed from the top front edge 180, a bottom front edge 170, a first front side edge 173, and a second front side edge 177. It is noted that here, the front face is rectangular, with first front side edge 173 and second front side edge 177 being substantially parallel to each other. However, this is not required. For example, the second front side edge 177, adjacent the open face 120, can be nonlinear (e.g. curved) or formed from multiple straight edges angled relative to adjacent edges, as illustrated in U.S. Design Patent Application Ser. No. 29/546,355 or 29/546,359, which are incorporated by reference.

The front face has an interior surface 142 and an exterior surface 144, with a generally constant thickness therebetween. As best seen in FIG. 2, a retainer 150 is fixed along the bottom edge 170 on the interior surface 142 of the front face 140. The retainer 150 is adapted to hold a heater cover panel in place, as will be illustrated further herein.

The rear face 160 is defined by the top rear edge 181, a bottom rear edge 171, the first rear side edge 174, and the second rear side edge 178. As illustrated here, the rear face is formed from two strips 162, 164 and has an opening 168. The first strip 162 is located along the top rear edge 181, and the second strip 164 is located along one of the rear side edges (here it is first rear side edge 174). However, it is also contemplated that the rear face could be solid with no openings.

The rear face 160 contains at least one bottom aperture 152 positioned along the bottom edge 171 of the rear face 160, which is adapted to accommodate a fastener (e.g. screw, nail, staple, etc.) for fixing the end cap 100 to a wall. As illustrated here, the bottom aperture 152 is adjacent the closed face 110, and is present on second strip 164. A top aperture 154 is located along the top edge 181 of the rear face 160. As illustrated here, the top aperture 154 is adjacent the open face 120. Put another way, the bottom aperture 152 and the top aperture 154 are located on opposite corners of the rear face. The top aperture is adapted to accommodate a fastener for additional attachment to a wall, or provide a means for additionally securing an inserted cover panel to the end cap with an associated fastener. A front hole 156 is located along a bottom edge 170 of the front face 140 and is adapted to provide an opening through which a tool can access the bottom aperture 152 and insert a fastener. As a result, here the front hole is positioned adjacent the closed face 110. In some embodiments as shown further below, a plurality of bottom apertures 152 or a plurality of top apertures 154 can be present in the rear face. It can be helpful if the front hole 156 is larger (i.e. greater diameter) than the bottom aperture 152. A removable or permanent plug 158 can be placed in the front hole 156 to restrict access to the fastener and provide a clean aesthetic.

It is noted that no bottom face is present. The sides of the end cap should be sized so that the top face 130 is generally parallel to the bottom face, which could be defined by bottom front edge 170, bottom rear edge 171, first bottom side edge 172, and second bottom side edge 176.

Figure 3:
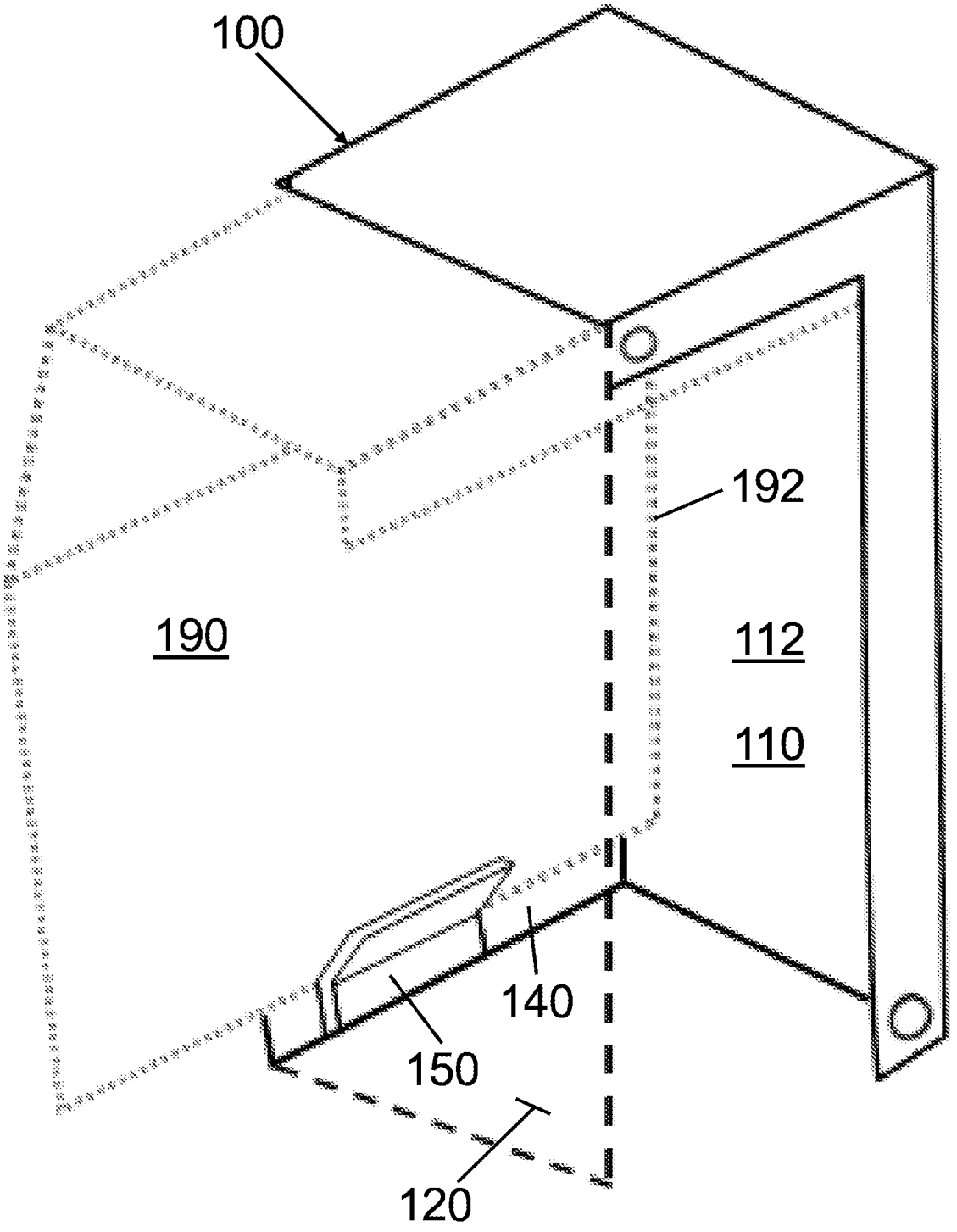
FIG. 3 is a rear perspective view of a heater cover panel inserted into the open face of the end cap of FIG. 2. The heater cover panel is illustrated with dashed lines, and the end cap is illustrated with solid lines.

FIG. 3 shows an end cap 100 with a heater cover panel 190 inserted through the open face 120 and into the interior volume of the end cap 100. As illustrated, the cover panel 190 is supported by the retainer 150 and fixed against the front face 140. The first end 192 of the cover panel abuts and is adjacent to the interior surface 112 of the closed face 110.

The end cap 100 is designed such that it can accommodate the heater cover panel 190 as well as fit over the end of a baseboard heater unit. When two end caps and a heater cover panel 190 are fully assembled, i.e. an end cap over each end of a baseboard unit and a cover panel with each panel end inserted into an end cap shielding the underlying baseboard unit, the end caps can be fastened to a wall to fix the heater cover panel in place and restrict its removal. A fastener, via a tool, can be inserted through the front hole 156 and threaded through each bottom aperture 152 and into a wall such that the end caps are then secured to the wall. The plug 158 can be inserted back into the hole 156 to restrict access to the fastener. While the end caps holding the heater cover panel 190 are fixed to the wall, access to the underlying baseboard heater unit is restricted. This deters unwanted tampering of the baseboarder heater unit (e.g. removing metal for scrapping or rewiring of the unit).

In preferred embodiments, the end caps are made from steel, specifically galvanized steel and preferably at least 22 gauge steel. The end caps can be power coated or painted to a desired color and to resist rusting of the steel.

Figure 4:
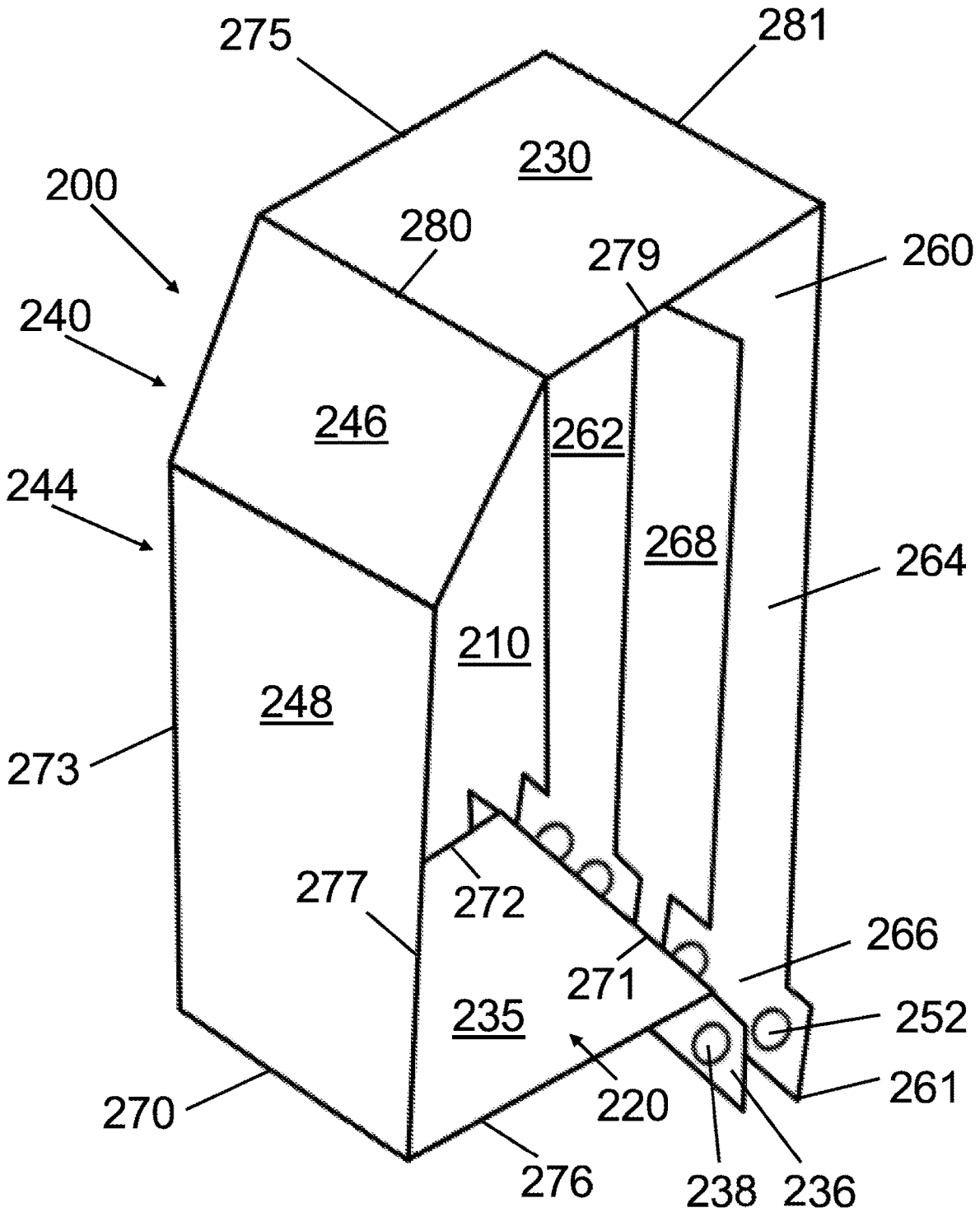
FIG. 4 is a front perspective view of a coupler according to one embodiment of the present disclosure.

FIG. 4 illustrates a coupler 200 for use in a heater cover assembly. The coupler is adapted to accommodate the insertion of two separate heater cover panels in each open face. The coupler 200 has a top face 230, a front face 240, a bottom face 235, and a rear face 260. The coupler has two open side faces 210, 220.

The top face 230 is generally solid, i.e. has no holes or vents. The perimeter of the top face is formed from a top front edge 280, a top rear edge 281, a first top side edge 275, and a second top side edge 279.

The front face 240 is connected to the top face 230 along the top front edge 280. As illustrated here, the front face 240 is made of an upper surface 246 and a lower surface 248, with the lower surface being vertical and the upper surface being angled relative to the lower surface. The design of the front face 240 can contain one surface or multiple surfaces, based upon design preferences. The perimeter of the front face is formed from the top front edge 280, a bottom front edge 270, a first front side edge 273, and a second front side edge 277. The exterior surface 244 is visible.

The bottom face 235 is connected to the front face 240 along the bottom front edge 270. The bottom face 230 is generally solid, i.e. has no holes or vents. The perimeter of the bottom face is formed from the bottom front edge 270, a bottom face rear edge 271, a first bottom side edge 272, and a second bottom side edge 276.

The rear face 260 is connected to the top face 230 along the top rear edge 281. The rear face hangs down from the top face. It should be noted that the rear face 260 is not directly connected to the bottom face 235.

The coupler can be attached to a wall by inserting fasteners through apertures. Two different sets of apertures are illustrated here. It is contemplated that only one such set of apertures needs to be present, though in some embodiments both sets of apertures are present.

First, the rear face 260 contains at least one rear face aperture 252 located along a bottom edge 261 of the rear face. The rear face aperture(s) 252 are adapted to accommodate a fastener for attachment to a wall.

As illustrated here, the rear face is formed from two vertical strips 262, 264, the rear face extends beyond the bottom face 235. The bottom edge 261 of the rear face is lower than the bottom face rear edge 271. There is an opening 268 between the two strips. The first strip 262 is located adjacent one side of the coupler, and the second strip 264 is located adjacent the opposite side of the coupler. Each strip terminates in a flange 266 in which at least one rear face aperture 252 is located; here, a plurality of rear face apertures 252 is present. Fasteners can be inserted through the rear face apertures 252.

Second, the bottom face 235 further comprises a tab 236 extending downwards from the bottom face rear edge 271. The tab extends from one open face 210 to the other open face 220, and in some embodiments can extend beyond the open side faces of the coupler 200. The tab 236 contains at least one tab aperture 238 adapted to accommodate a fastener which can be used to fasten the coupler to a wall. When both sets of apertures 252, 238 are present, they should be substantially aligned with each other so that one fastener can pass through both sets of apertures. As a result, the rear face and bottom face are selectively attachable to each other.

Although not visible here, it is contemplated that in some embodiments a retainer can be attached to the interior surface of the front face of the coupler. The coupler would be adapted to accommodate at least one cover panel. The retainer would operate in the same fashion as described above with respect to FIG. 2.

In preferred embodiments the coupler 200 is made from steel, specifically galvanized steel. The coupler can be powder coated or painted to a desired color and to resist rusting of the steel. The steel is preferably at least 22 gauge steel.

Figure 5A:
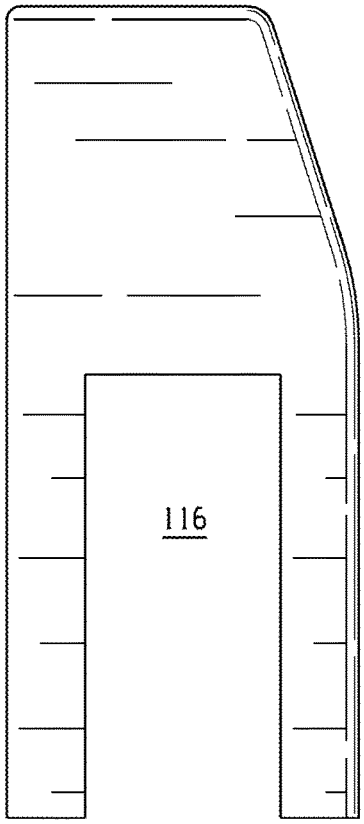
FIGS. 5A-5D are photographs of another exemplary end cap having a cutout in the closed face.
Figure 5B:
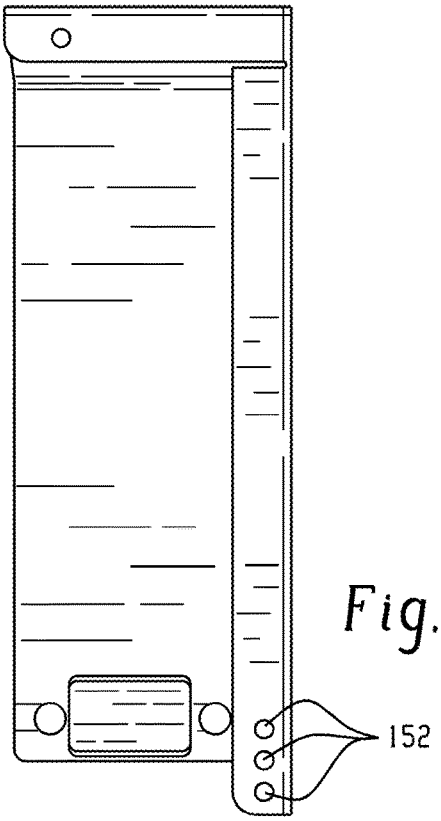
Figure 5C:
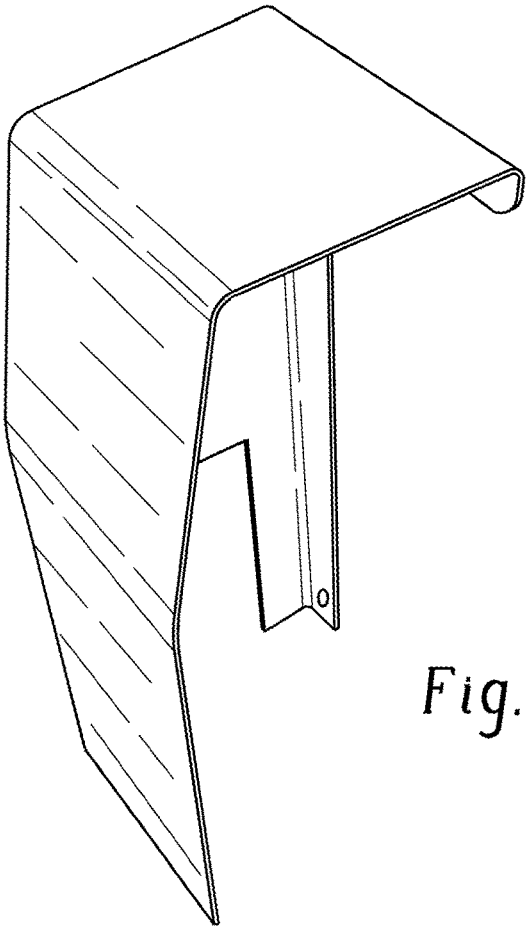
Figure 5D:
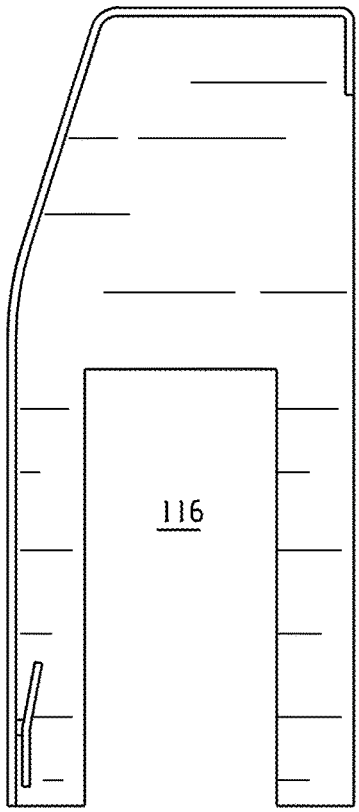
Figure 6A:
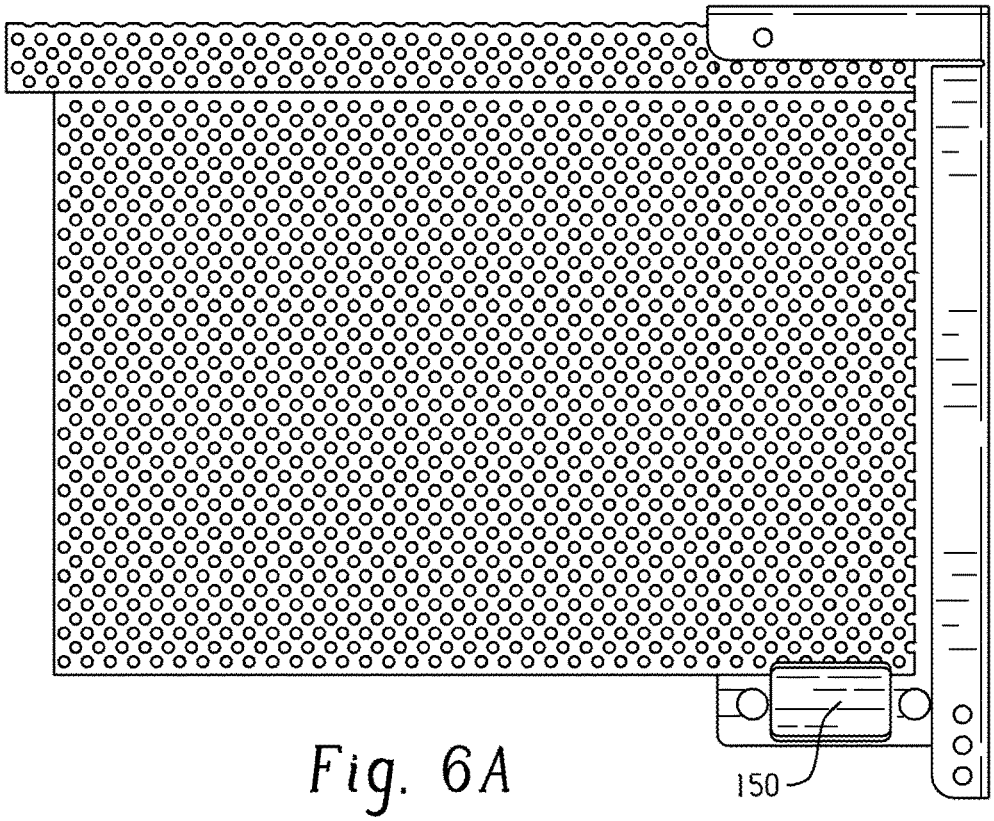
FIG. 6A is a rear view of the end cap with an inserted heater cover panel.
Figure 6B:
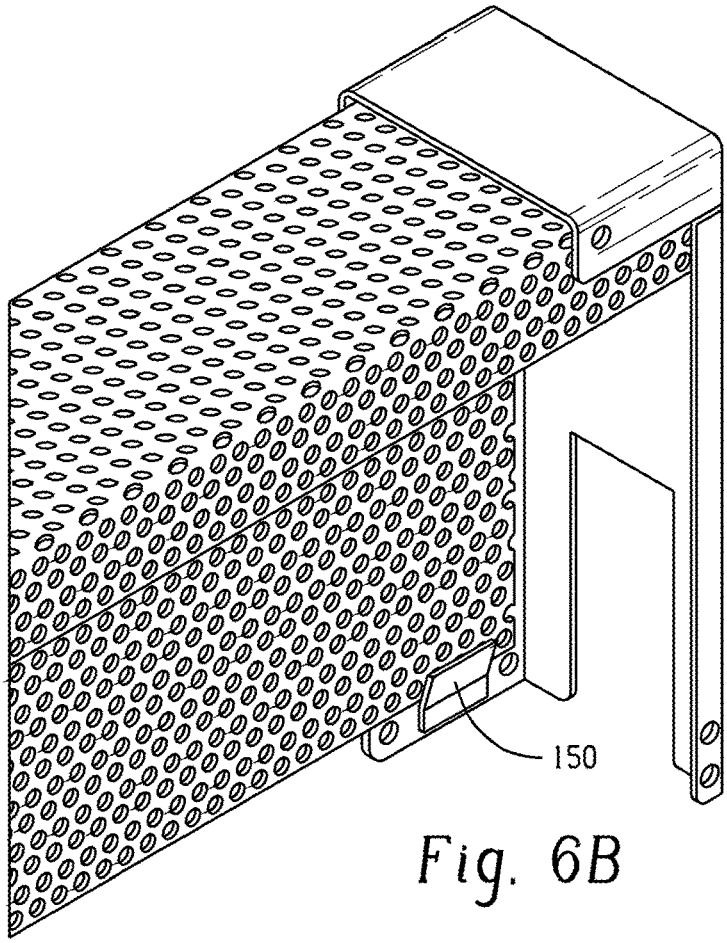
FIG. 6B is a perspective rear view of the end cap with the inserted heater cover panel.

FIGS. 5A-5D are photographs of another exemplary end cap. This end cap is similar to that depicted in FIG. 1 and FIG. 2. However, here the closed face of the end cap includes a cutout 116, here having a rectangular shape. In FIG. 5B, multiple bottom apertures 152 are present on the rear face. This can permit multiple fasteners to be used, or can accommodate fasteners with heads of different sizes. The bottom apertures are arranged vertically, one above another, FIG. 6A and FIG. 6B are photographs of a heater cover panel inserted into an end cap. FIG. 6A illustrates best how the retainer 150 of the end cap interacts with the heater cover panel. The heater cover panel includes vents through which heated air passes. The vents themselves can be of any desired shape: rectangular, square, triangular, oval (elliptical), circular, etc. The heater cover panel should retain sufficient solidity that the internal components of the baseboard heater themselves are still fairly well hidden and difficult to see through the cover panel.

Figure 7A:
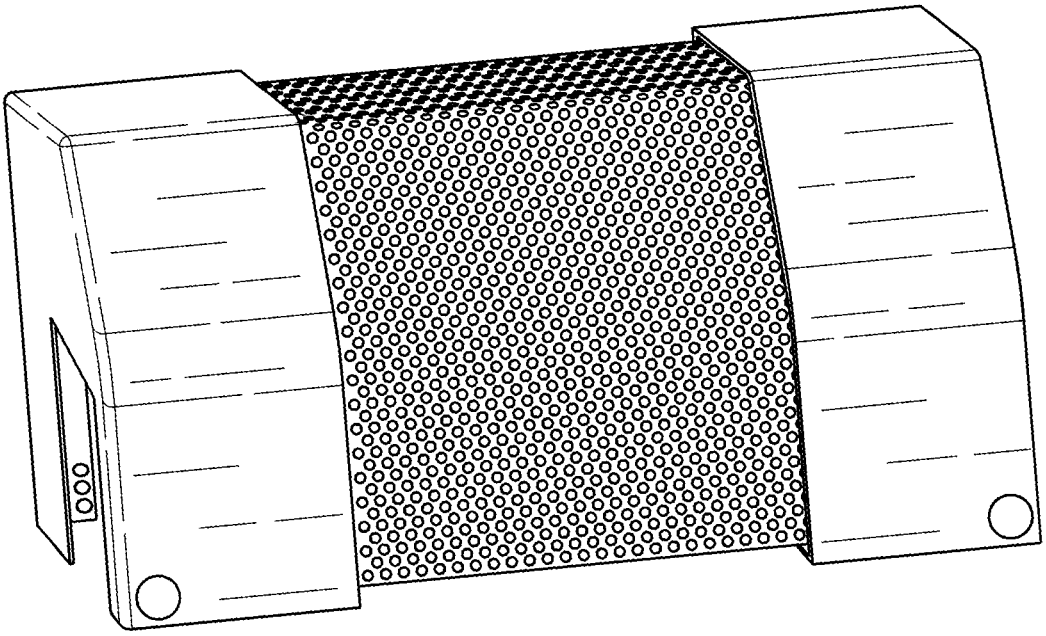
FIGS. 7A-7C are photographs of a baseboard heater cover assembly, showing two end caps and a heater cover panel.
Figure 7B:
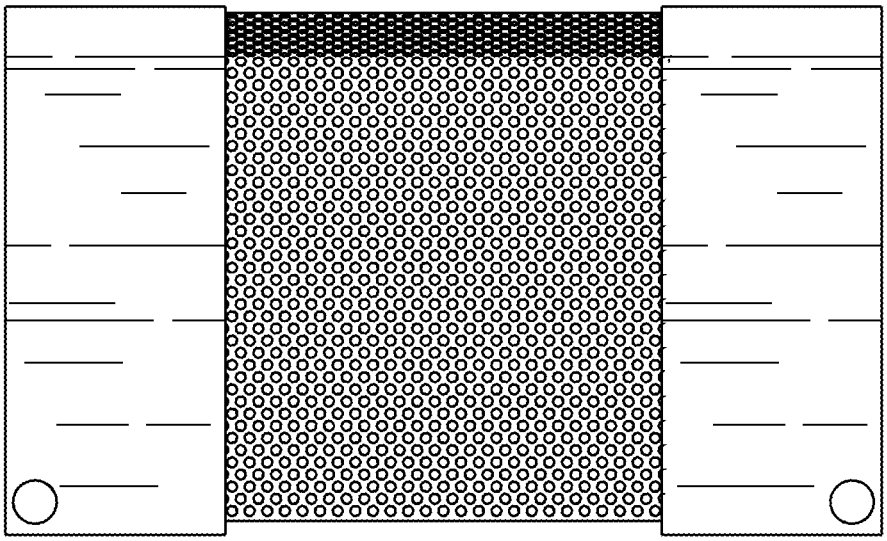
Figure 7C:
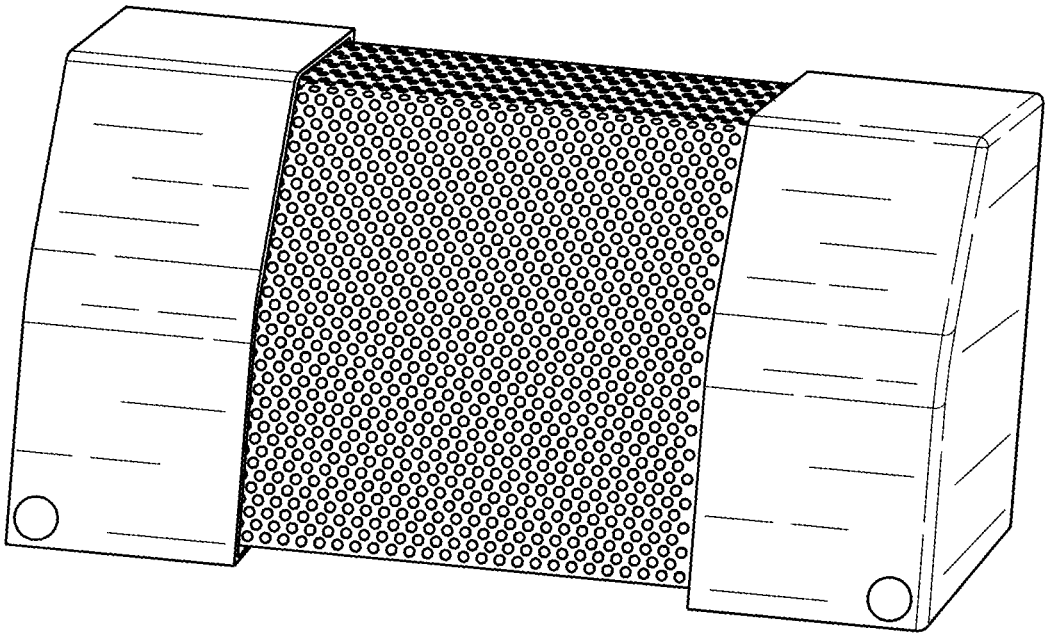
Figure 8A:
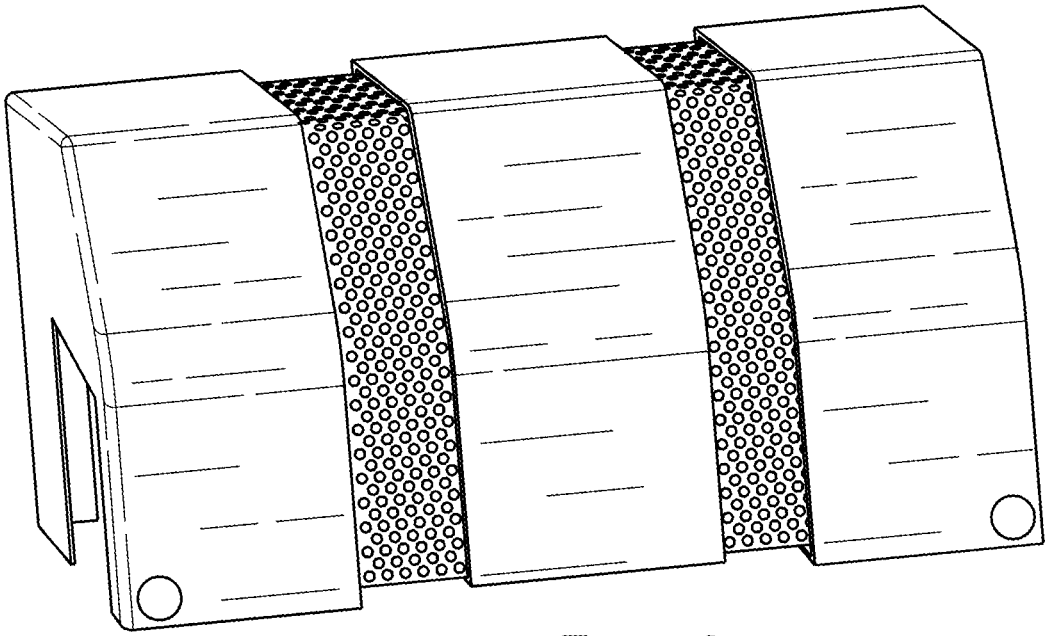
FIG. 8A is a perspective view of a baseboard heater cover assembly including a coupler.
Figure 8B:
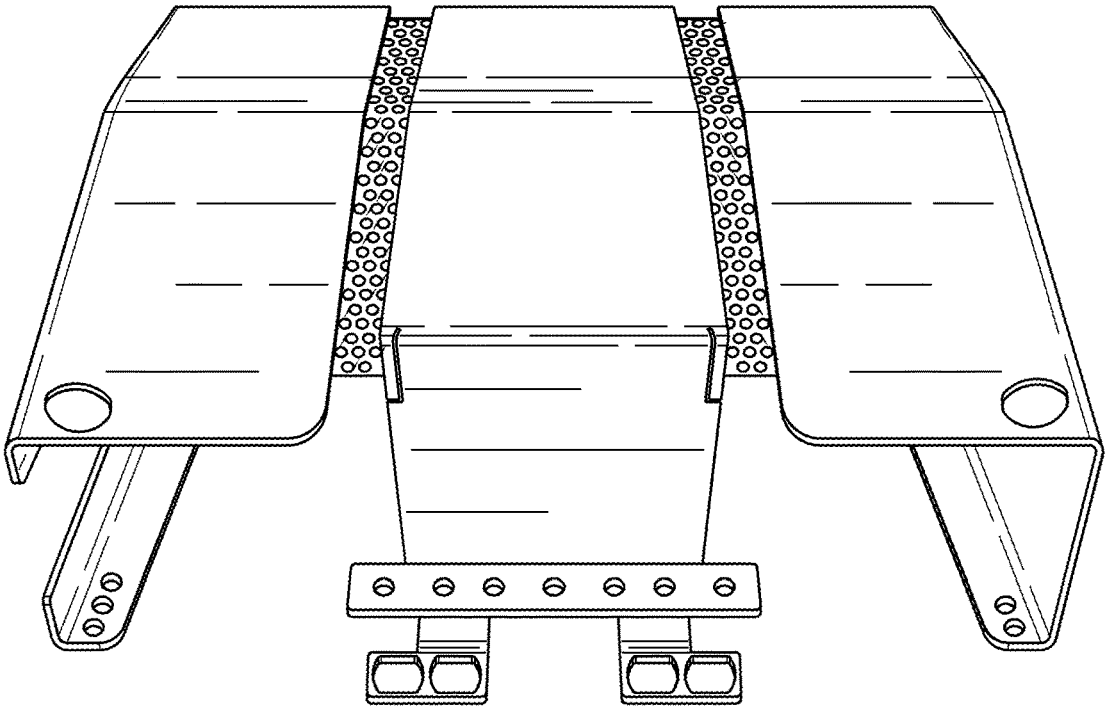
FIG. 8B is a bottom perspective view, with additional aspects of the components being visible.
Figure 9A:
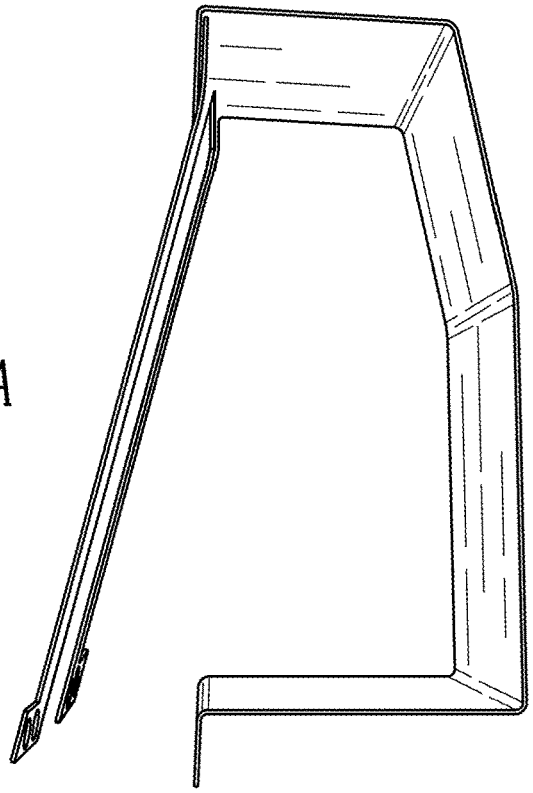
FIGS. 9A-9C are photographs of a coupler.
Figure 9B:
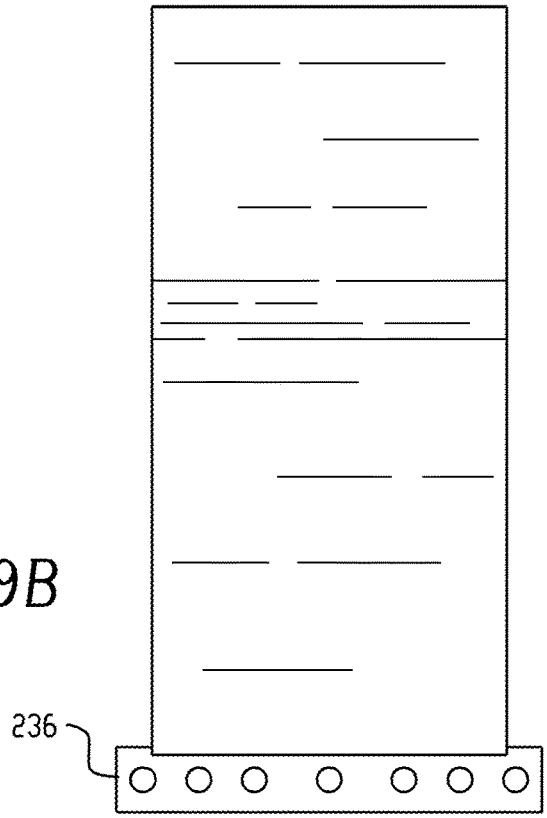
Figure 9C:
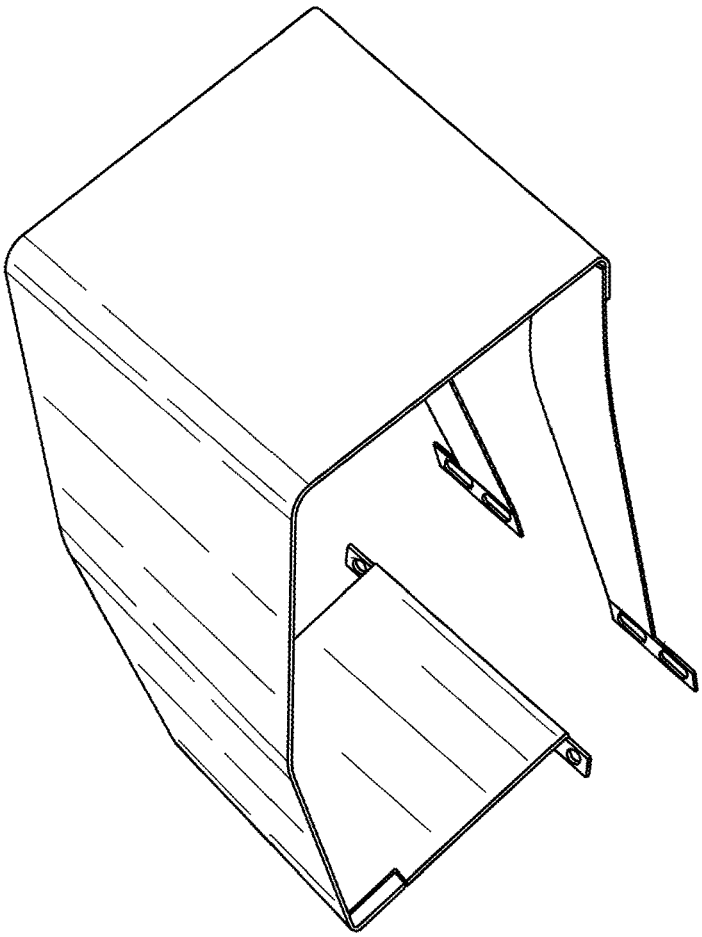

FIGS. 7A-7C show a heater cover panel and two end caps operating together as a heater cover assembly. FIGS. 8A-8B show a heater cover panel, two end caps, and a coupler. FIGS. 9A-9C are photographs of an exemplary coupler. FIG. 9A shows how the rear face can flex to be placed around the baseboard heater unit. The tab 236 having multiple apertures is most visible in FIG. 9B.

Figure 10:
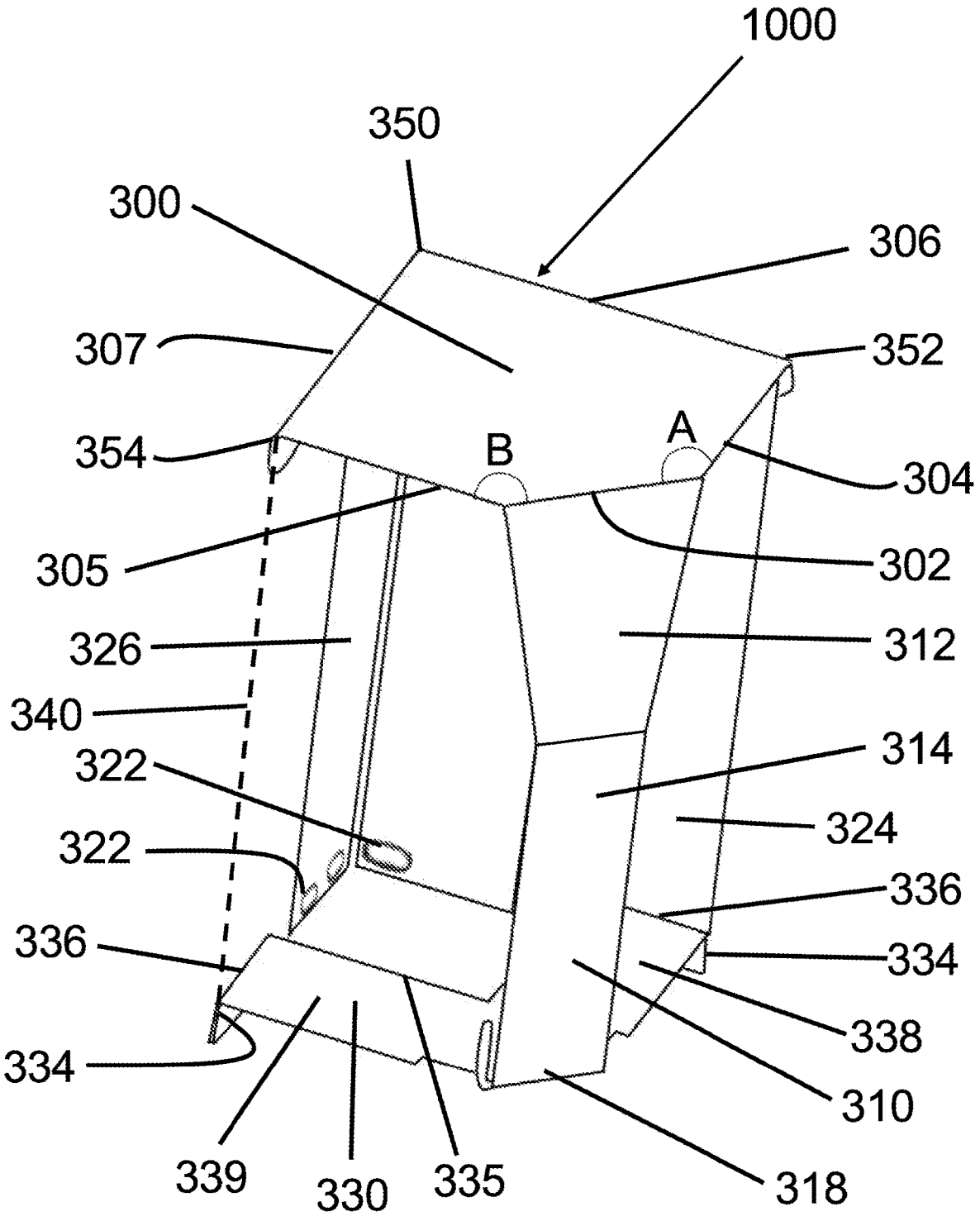
FIG. 10 is a front perspective view of one corner piece according to the present disclosure. Here, there is a full rear face adjacent to a partial rear face, and the bottom face has first and second leg portions.
Figure 11:
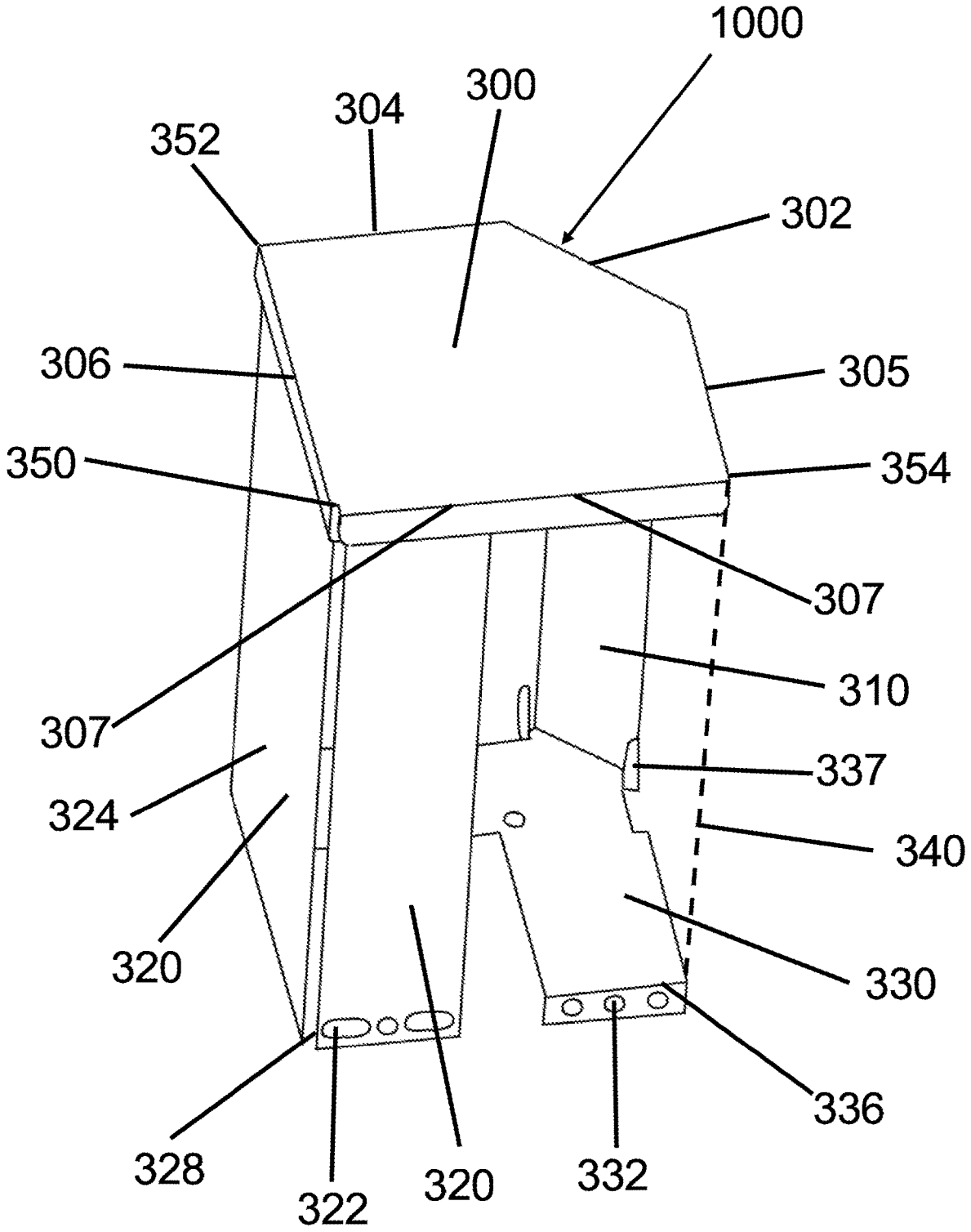
FIG. 11 is a rear perspective view of the corner piece of FIG. 10.

A first exemplary embodiment of a corner piece is shown in FIG. 10 and FIG. 11. FIG. 10 is a front perspective view and FIG. 11 is a rear perspective view. The corner piece 1000 is formed from a top face 300, a front face 310, at least one rear face 320, a bottom face 330, and two open side faces 340.

The perimeter of the top face 300 is formed from a front edge 302, a first side edge 304, a second side edge 305, a first rear edge 306, and a second rear edge 307. The top face 300 has five sides and is configured such that the first rear edge 306 meets the second rear edge 307 at a rear corner 350 of the top face. The first side edge 304 meets the first rear edge 306 at a first side corner 352. The second side edge 305 meets the second rear edge 307 at a second side corner 354. The top face 300 is generally solid, i.e. has no holes or vents.

In the embodiment shown in FIG. 10 and FIG. 11, the first side face 304 and the second rear face 307 are generally parallel to one another and the second side face 305 and the first rear face 306 are generally parallel to one another. The angle between the first rear edge 306 and the second rear edge 307 at the rear corner 350 is approximately 90°. The front edge 302 of the top face 300 is angled relative to the first and second side edges 304, 305. In this embodiment, the angle A between the front edge 302 and the first side edge 304 is about 135°. The angle B between the front edge 302 and the second side edge 305 is also about 135°.

Figure 13:
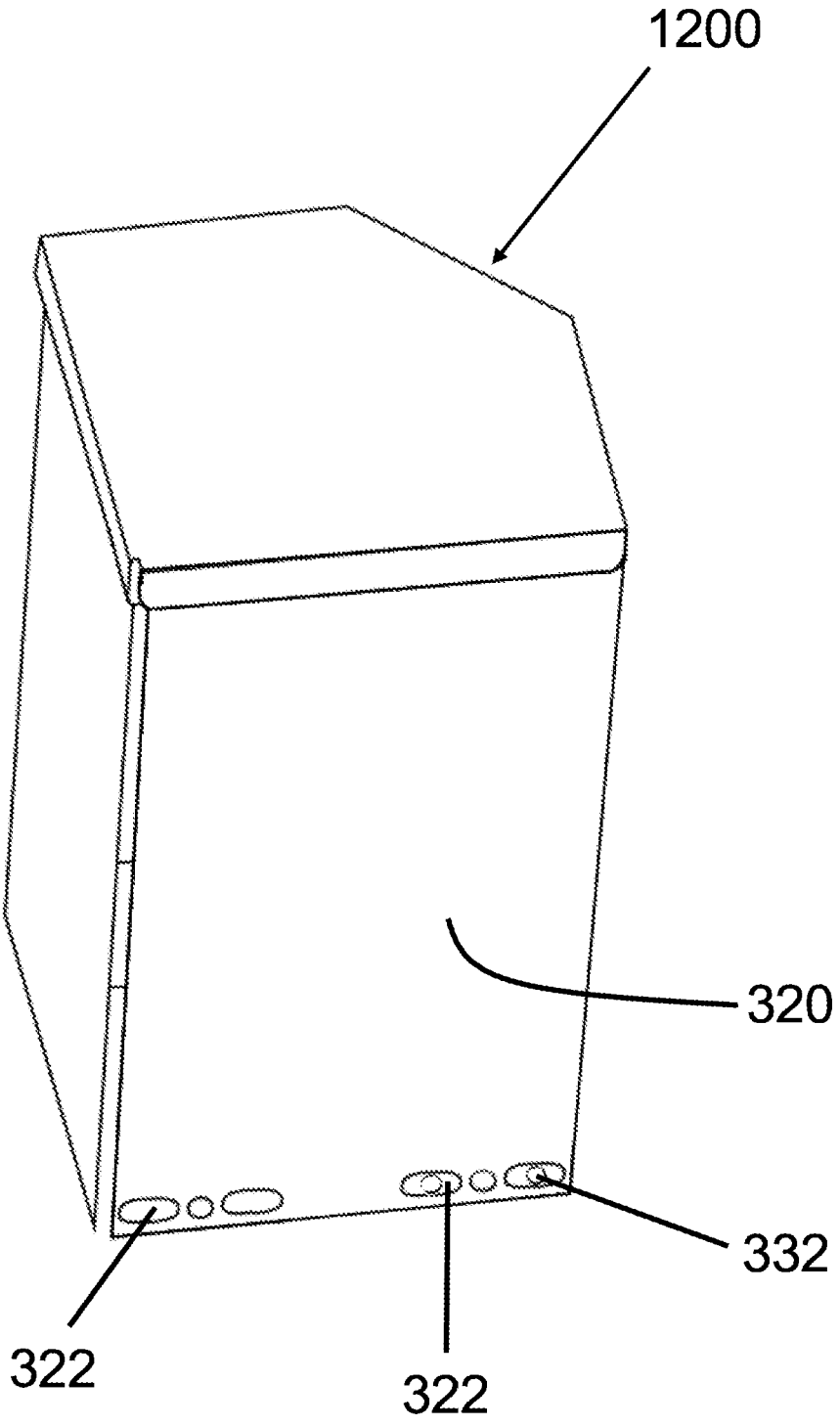
FIG. 13 is a rear perspective view of the corner piece of FIG. 12.

As can be seen in FIG. 11 and FIG. 13, the top face 300 may be curled downward along the first and second rear edges 306, 307 over a portion of the rear face 320. This curled-down portion, or "lip", is to be understood as constituting part of the top face 300 and may be present in order to provide a surface for attaching the top face 300 to the rear face 320.

The front face 310 extends downwardly from the front edge 302 of the top face 300. As illustrated here, the front face 310 is made of an upper surface 312 and a lower surface 314, with the lower surface being vertical and the upper surface being angled relative to the lower surface. The design of the front face 310 can contain one surface or multiple surfaces, based upon design preferences. The perimeter of the front face is formed from the top front edge 302, a bottom front edge 318, a first front side edge, and a second front side edge.

The corner piece further includes at least one rear face 320. In the embodiment shown in FIG. 10 and FIG. 11, two rear faces 324, 326 are present. The rear face 320 extends downwardly from the first rear edge 306 or from the second rear edge 307 of the top face 300. The precise location of the rear face 320 may vary. For example, in the embodiment shown in FIG. 10 and FIG. 11, a first rear face 324 and second rear face 326 are shown. The first rear face 324 extends from the first rear edge 306 of the top face 300. The first rear face 324 can be considered a full rear face because it extends substantially the entire length of the first rear edge 306. That is, the first rear face 324 extends from the rear corner 324 to the first side corner 352. The second rear face 326 extends from the second rear edge 307 of the top face 300, and is adjacent the rear corner 150 or adjacent the first rear face 324. The second rear face 326 can be considered a partial rear face because it does not extend substantially the entire length of the rear edge and is not solid for that entire length, or alternatively the second rear face 326 can be considered as including an opening or a gap.

The rear face 320 has a bottom edge 328. The bottom edge 328 of the rear face 120 has at least one rear face aperture 322. The aperture 322 may be of any suitable size or shape and is generally adapted to accommodate an associated fastener for securing the corner piece 1000/baseboard heater cover to an associated wall once installed. Once installed, the corner piece 1000/baseboard heater cover cannot be quickly or easily removed without removing the associated fastener. In this regard, the aperture 322 may be designed to accommodate specialty fasteners that are not removable without specially-designed tools. It is to be understood that the rear face 320 may include as many apertures 322 as is desired, such as is shown in FIG. 11 and FIG. 13. Additional apertures provide for more security between the baseboard heater cover and the associated wall. The apertures 322 may be dimensioned and spaced to provide the desired amount of security. Furthermore, it is to be understood that the apertures 322 can be used to provide desired convective heat transfer away from predetermined areas of the associated baseboard heater.

The bottom face 330 extends from a bottom edge 318 of the front face 310. The bottom face 330 extends inwardly from the front face 310 such that at least a portion of the bottom face 330 is below the top face 310 once installed, such as is shown in the embodiment in FIG. 10 and FIG. 11. The bottom face 330 has a lip 334 at a distal edge 336 of the bottom face 130. The distal edge 336 should be very close to the rear face 320. The lip 334 extends downwardly from the distal edge 336 and has at least one lip aperture 332. The lip aperture 332 may be of any suitable size or shape and is generally adapted to accommodate an associated fastener for securing the corner piece 1000/baseboard heater cover to an associated wall once installed.

In the embodiment shown in FIG. 10 and FIG. 11, the bottom face 330 has a first leg portion 338 and a second leg portion 339 extending from the bottom edge 318 of the front face 310. Put another way, there is an opening in the bottom face, or the bottom face is not completely solid. Generally, the first and second leg portions 338, 339 extend in different directions such that they are at an angle relative to one another. It is to be understood that the angle between the first and second leg portions 338, 339 can be varied as desired. In this embodiment, the angle between the first and second leg portions is approximately 90°, which angle is measured between inner edges 335 of the first and second leg portions. As such, this embodiment features a bottom face 330 having a generally L-shaped cross-section.

It is to be understood that the bottom face 330 may include as many leg portions as is desired and that such leg portions may be of any suitable size, shape, and configuration. Generally, each leg portion has a lip 334 at a distal end 336 of the leg portion, and each lip generally includes at least one lip aperture 332. The apertures can be dimensioned and spaced in any manner desired, such as has already been explained with regard to the aperture 322 of the rear face 320. The lip aperture 332 can be aligned with a rear face aperture 322, so that a common fastener can pass through both apertures (e.g. on the first side 324, 338), or they can be independent of each other (e.g. on the second side 326, 339).

As can be best seen in FIG. 11, the bottom face 330 may further include at least one retainer 330. The retainer serves to secure associated heater cover panels near the front face of the corner piece. Generally, the retainer 337 is formed as part of the bottom face 330 and is cut therefrom. The retainer 337 is then bent upwardly from the bottom face 330 towards the top face 300. The retainer 337 may be of any suitable size and shape. It is to be further understood that the retainer 337 may be placed anywhere along the bottom face 330 that is desirable.

As can also be seen in FIG. 11, the bottom face 330 may include its own aperture. The aperture in the bottom face can be used as another point at which the corner piece 1000/baseboard heater cover may be secured using an associated fastener, or, alternatively, to provide desired convective heat transfer away from predetermined areas of the associated baseboard heater.

Finally, the corner piece has two open side faces 340. Each open face gives access to the interior volume of the corner piece and accommodates the insertion of a heater cover panel, as will be described further herein. The perimeter of each open side face is formed from a top side edge, a rear side edge, a front side edge, and a bottom side edge.

Figure 12:
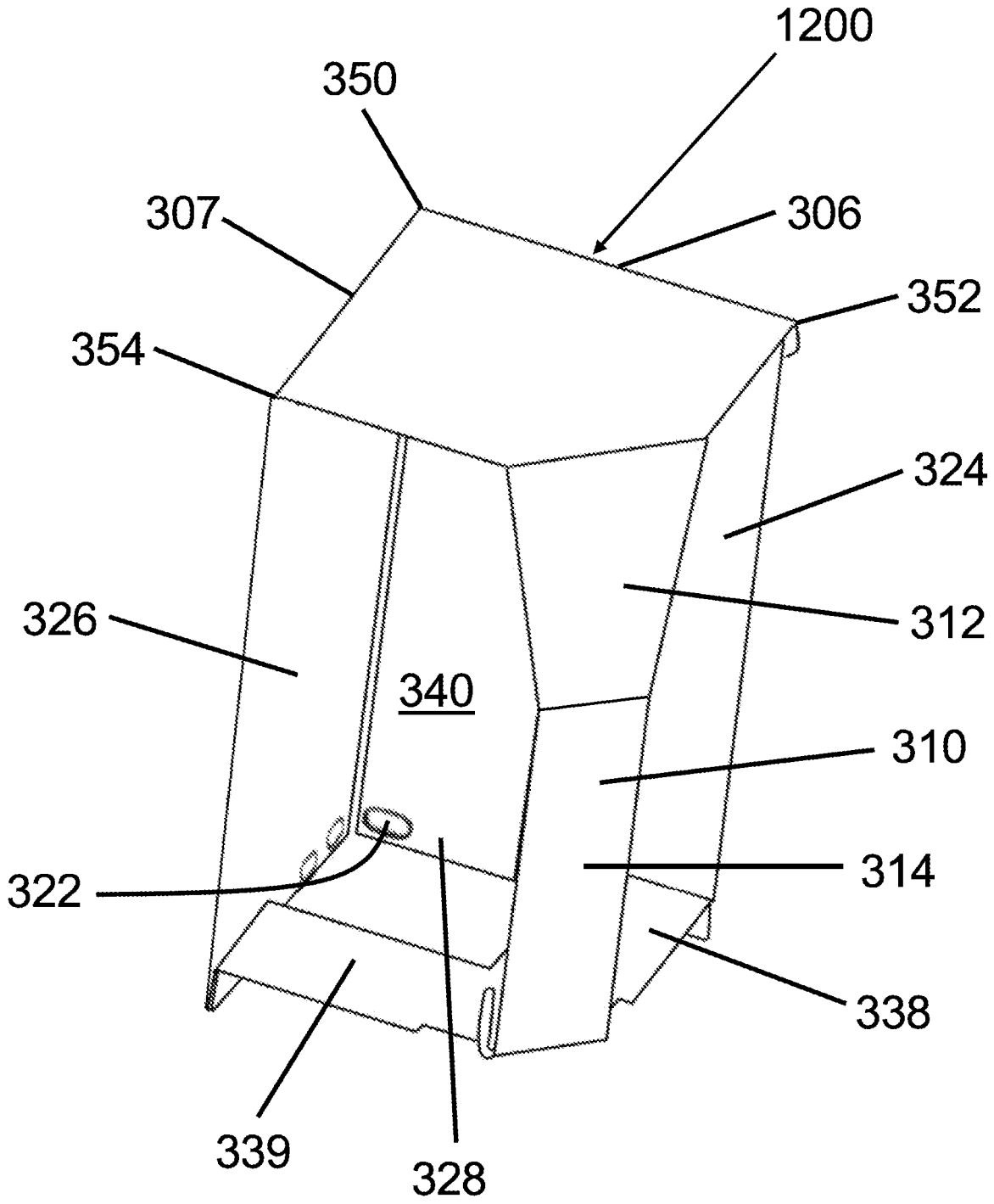
FIG. 12 is a front perspective view of another corner piece according to the present disclosure. Here, two full rear faces are present and the bottom face has first and second leg portions.

FIG. 12 and FIG. 13 illustrate another exemplary embodiment of a corner piece of the present disclosure. In the embodiment shown in FIG. 12, the front face 310 also has an upper surface/portion 312 and a lower surface/portion 314. The upper and lower surfaces/portions 312, 314 of the front face 310 may be angled relative to one another. The angle between the upper and lower portions 312, 314 of the front face 310 may be varied as desired for aesthetic appeal. In this regard, the front face 310 may be of any suitable size, shape, or configuration and is generally the same shape as the associated baseboard cover pieces to which it is designed to mate. In addition, both the first rear face 324 and the second rear face 326 are full rear faces that each extend substantially the entire length of its respective rear edge. That is, the first rear face 324 extends from the rear corner 350 to the first side corner 352 along the first rear edge 306, and the second rear face 326 extends from the rear corner 350 to the second side corner 354 along the second rear edge 307.

The bottom face 330 may extend from the bottom edge 318 of the front face 310 as far as is desired. It is generally desirable, however, for the bottom face 330 to extend to a plane created by the first and second rear edges 306, 307. More particularly, it is desirable to design the corner piece 1000 such that the bottom face 330 extends to and abuts the rear face 320. As is shown in FIG. 13, it is further desirable to place the lip aperture 332 of the bottom face 330 in alignment with the aperture 322 of the rear face 320. In this way, a single associated fastener can be passed through both apertures to secure the corner piece 1000/baseboard heater cover to an associated wall. For example, FIG. 12 shows an embodiment in which the second leg portion 339 of the bottom face 330 extends to and abuts a second rear face 326, while a first leg portion 338 of the bottom face 330 extends to and abuts a first rear face 324.

Figure 14:
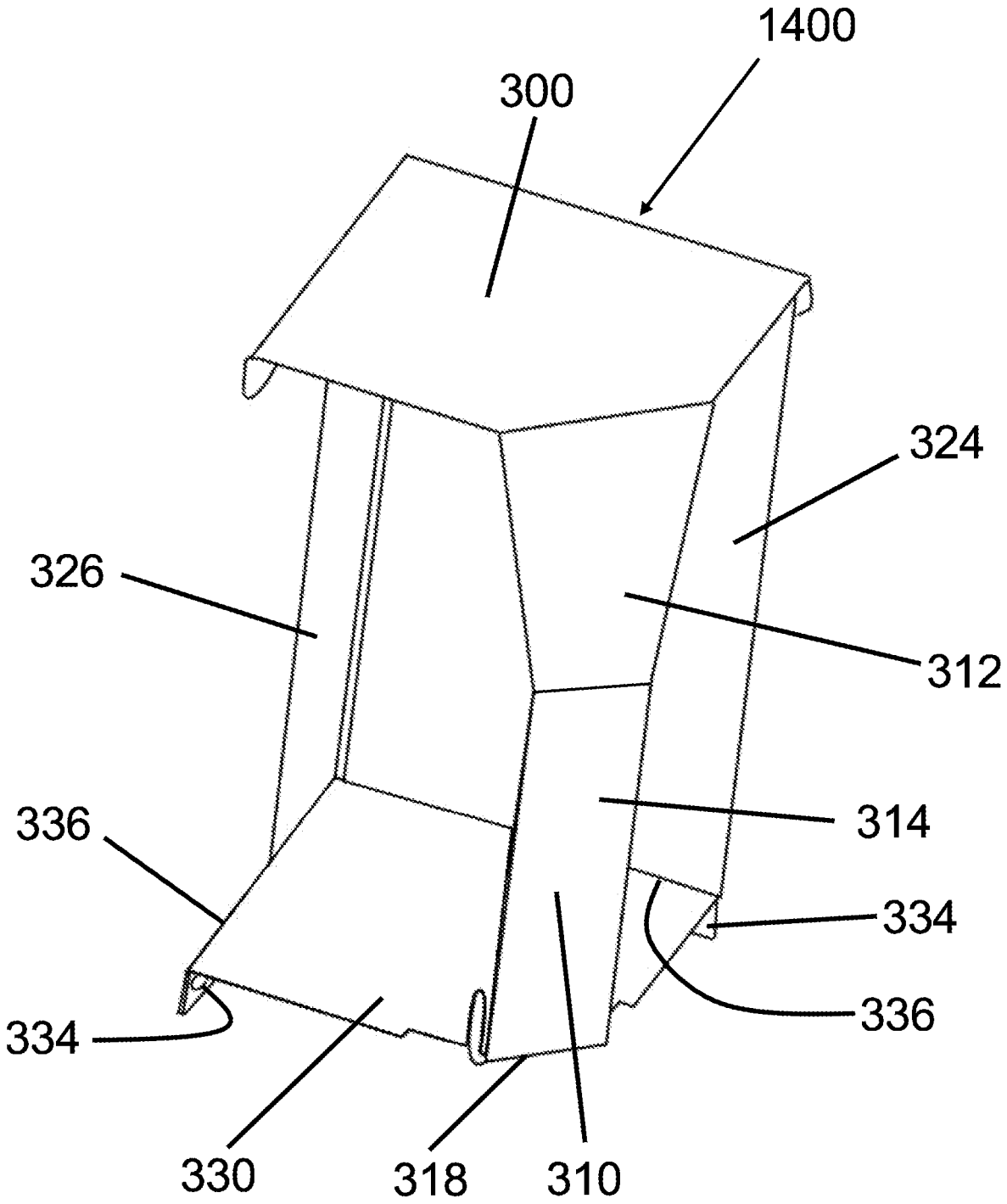
FIG. 14 is a front perspective view of a corner piece according to the present disclosure. Here, the bottom face is a full bottom face with a first rear edge and a second rear edge, covering the entirety of the area between the rear faces and the front face.

Turning now to FIG. 14, additional features of a corner piece according to the present disclosure can be seen, which can be contrasted with FIG. 10 and FIG. 12. In the embodiment shown in FIG. 14, the bottom face 330 is a full bottom face. That is, the bottom face 330 extends from the bottom edge 318 of the front face 310 to rear faces 324, 326, such that the bottom face 330 is closed or is a solid surface. This embodiment does not have leg portions as in the embodiments of FIG. 10 and FIG. 12. In this way, the cross-section of the bottom face 330 is substantially similar in shape and configuration to the top face 300. With such a construction, it is advantageous that the bottom face 330 and the top face 300 are substantially parallel to one another once installed. Further, as shown in FIG. 14, when the bottom face 330 is a full bottom face, each distal rear edge 336 has a lip 334 extending downwardly therefrom, with a lip aperture therein (not visible).

Figure 15:
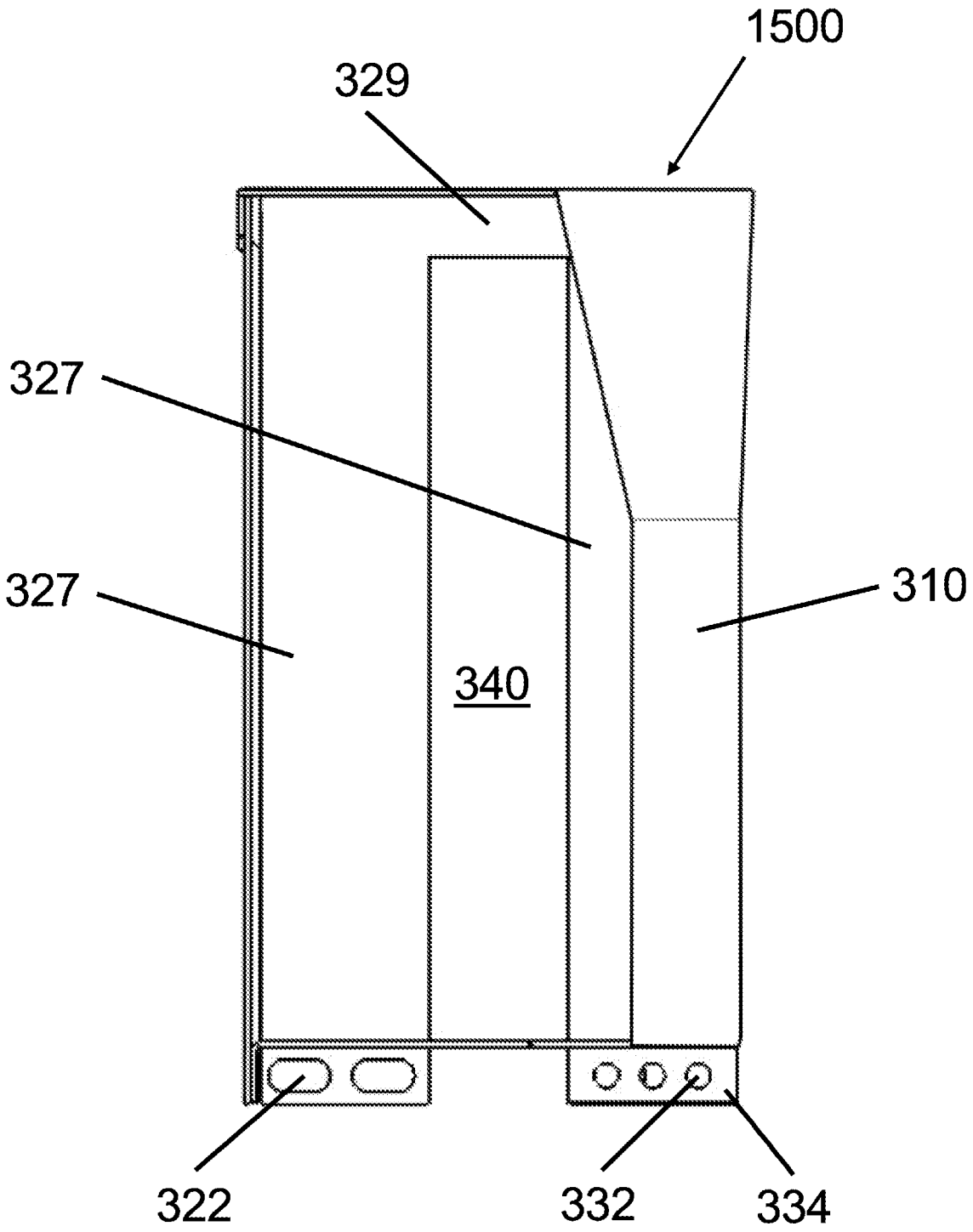
FIG. 15 is a side view through one of the open side faces of a third embodiment of a corner piece according to the present disclosure. Here, the rear faces are formed from rear face finger portions.
Figure 16:
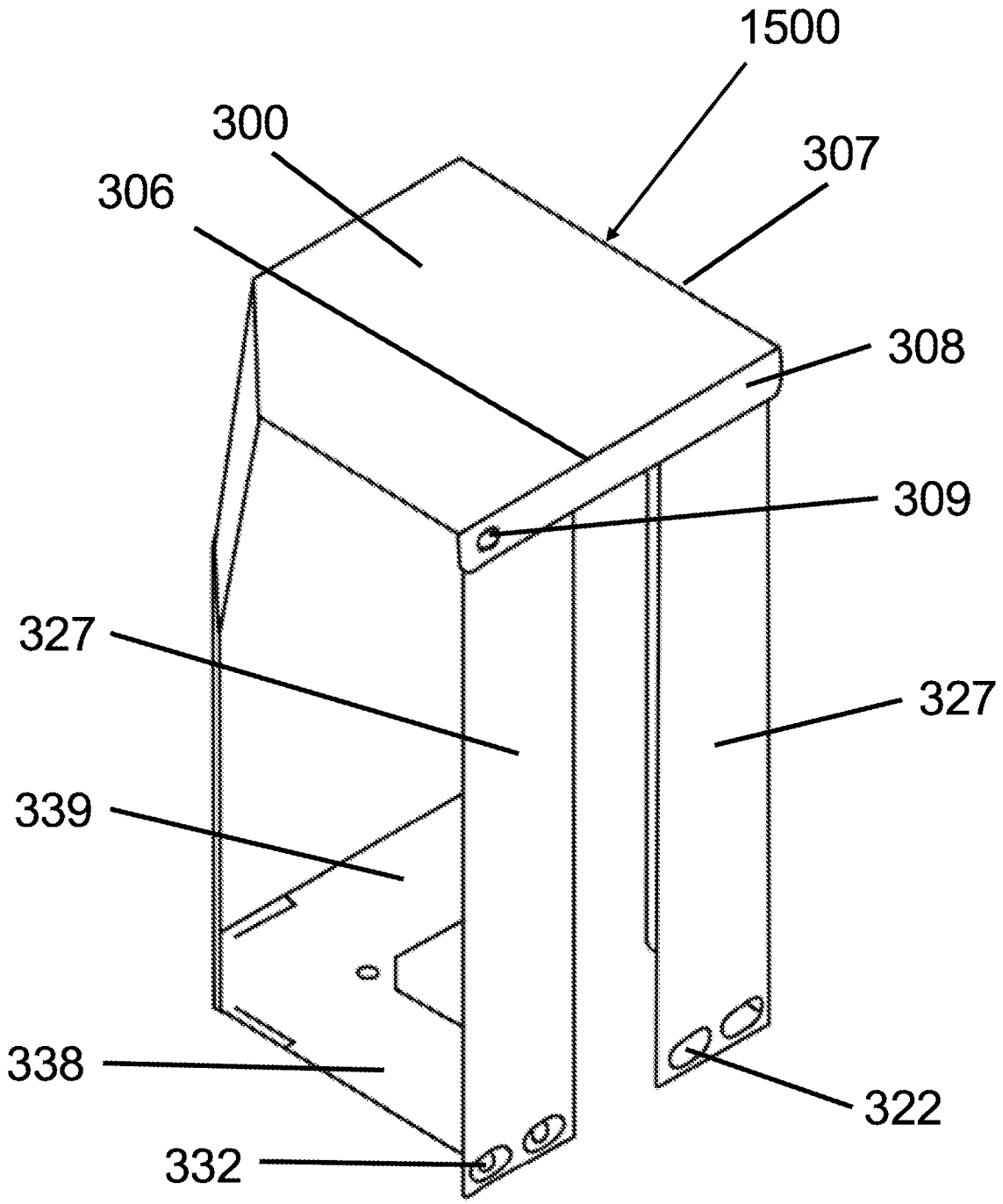
FIG. 16 is a rear perspective view of the corner piece of FIG. 15.
Figure 17:
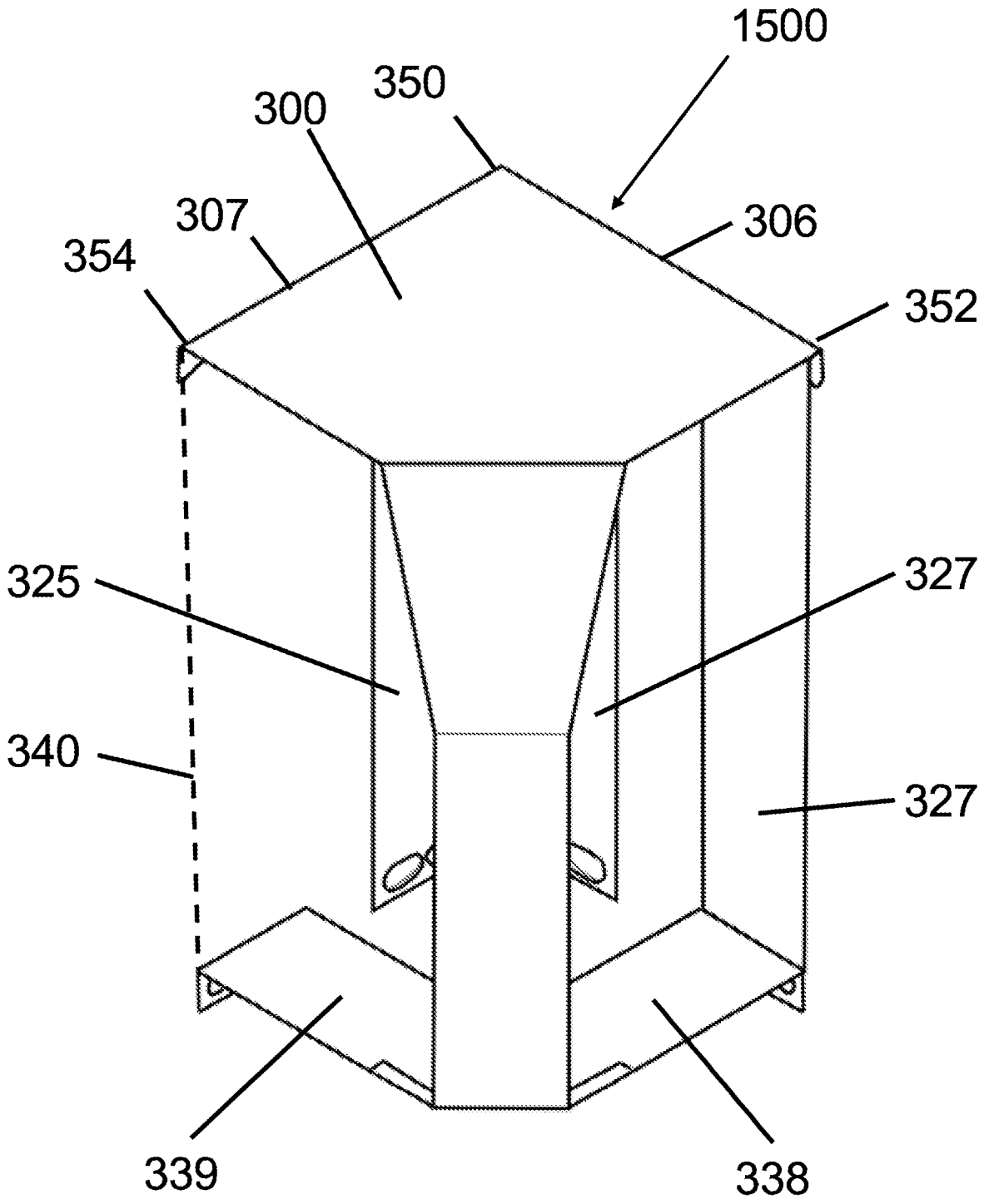
FIG. 17 is a front perspective view of the corner piece of FIG. 15 and FIG. 16.

FIGS. 15-17 show yet another embodiment of a corner piece according to the present disclosure. FIG. 15 is a side view through one of the open side faces 340 of the corner piece 1000. As seen in FIG. 15, the first rear face has two finger portions 327. The first rear face finger portions 327 generally extend downward from the first rear edge 306 of the top face 300 towards the bottom face 330. Each first rear face finger portion 327 can be considered a partial rear face portion because neither finger portion alone extends substantially the entire length of the rear edge and is not solid for that entire length, or alternatively the first rear face finger portions 327 can be considered as including an opening or a gap therebetween. Generally, one of the first rear face finger portions 327 is adjacent the rear corner 350 of the top face 300 and another of the first rear face finger portions 327 is adjacent the first side corner 352 of the top face 300. Put another way, there is generally an opening in the first rear face between the first rear face finger portions, or the first rear face is not completely solid. The first rear face finger portions 327 are generally connected to one another by a rear face finger portion connector 329. As seen in FIG. 15, the rear face finger portion connector 329 connects the first rear face finger portions 327 adjacent their top edges (i.e., proximate the top face 300), though it is to be understood that the rear face finger portion connector 329 can be placed anywhere along the rear face finger portions for the desired interconnection therebetween. Of course, the rear face finger portions could also be two separate pieces.

FIG. 16 is a rear perspective view of the embodiment of the corner piece 1000 of FIG. 15. As shown in FIG. 16, the top face 300 can include a lip 308. The lip 308 of the top face 300 generally extends downward from the first rear edge 306 of the top face 300 towards the bottom face 330. The lip 308 generally covers at least a portion of the first rear face or the second rear face. It is contemplated that a similar lip can be provided on the second rear edge 307 of the top face 300 to cover at least a portion of the second rear face, such as is shown in FIG. 16. The lip 308 may include an aperture 309 therein. As shown in FIG. 16, the aperture 309 in the lip 308 of the top face 300 can align with an aperture in the portion of the rear face(s) covered by the lip. The aperture 309 may be of any suitable size or shape and is generally adapted to accommodate an associated fastener for securing the corner piece 1000 to an associated wall once installed. Once installed, the corner piece cannot be quickly or easily removed without removing the associated fastener. In this regard, the aperture 309 may be designed to accommodate specialty fasteners that are not removable without specially-designed tools. It is to be understood that the lip 309 of the top face 300 and the rear face 320 may include as many apertures as is desired, such as is shown in FIG. 11 and FIG. 13. Additional apertures provide more possible attachments between the corner piece 1000 and the associated wall. The apertures may be dimensioned and spaced as desired.

As can be best seen in FIG. 17, the front corner piece 1000 includes a single second rear face finger portion 325. That is, the second rear face 326 is not a full rear face. The rear face can be considered as including a single rear face finger portion 325 or, as explained above, as a partial rear face because it does not extend substantially the entire length of the second rear edge 307 of the top face 300 and is not solid for that entire length, or alternatively the second rear face can be considered as including an opening or a gap. As shown in FIG. 17, the single finger portion 325 of the second rear face 326 extends from the second rear edge 307 of the top face 300, and is adjacent the rear corner 350, though it is to be understood that the second rear face finger portions can be positioned anywhere between the rear corner 350 and the second side corner 354. Put another way, there is generally an opening in the second rear face, or the second rear face is not completely solid.

Figure 18:
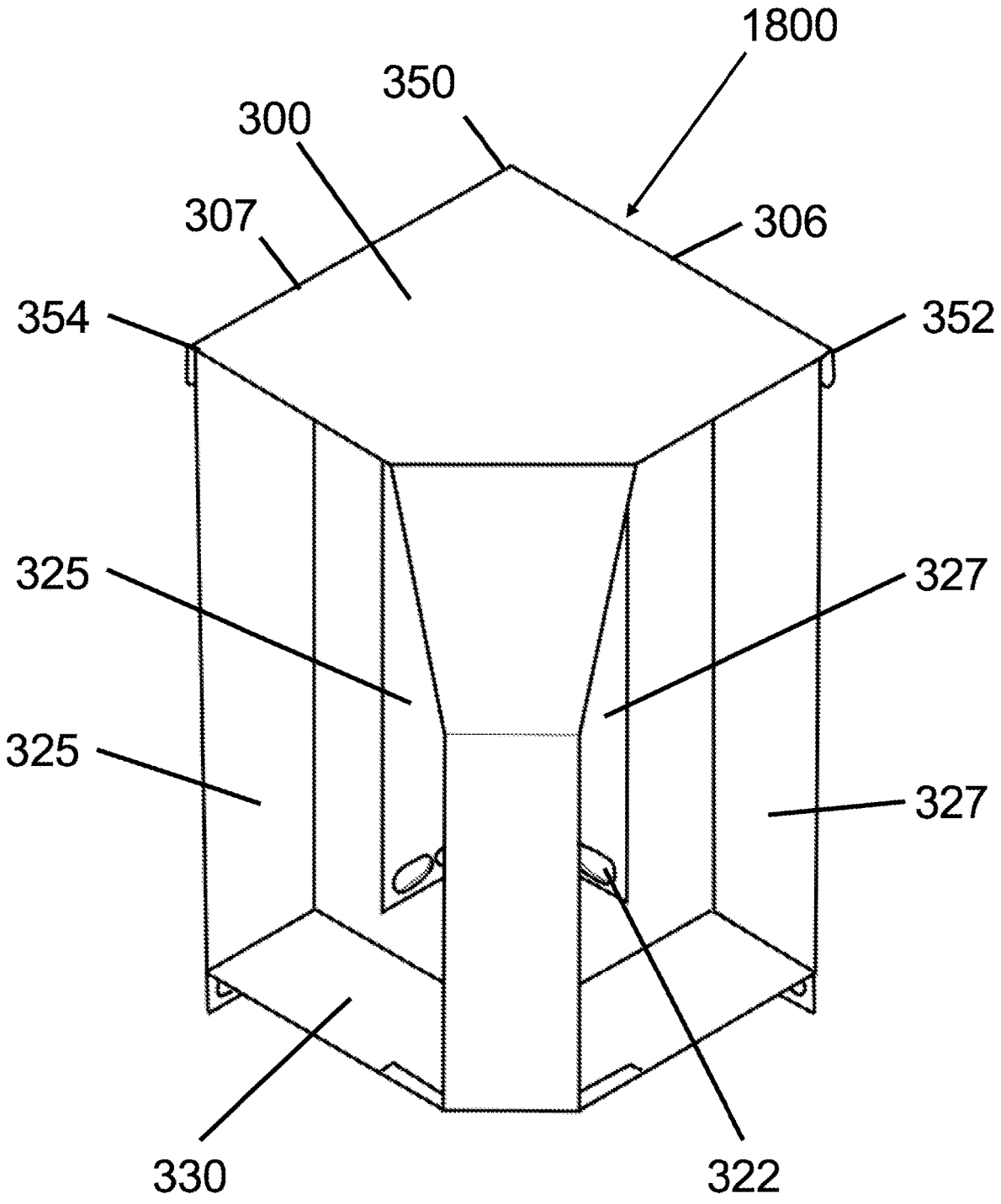
FIG. 18 is a front perspective view of a fourth exemplary embodiment of a corner piece according to the present disclosure. Here, the two rear faces are each made from two rear face finger portions, and the bottom face has first and second leg portions.

Turning now to FIG. 18, additional features in another embodiment of a corner piece according to the present disclosure are visible. The corner piece 1000 of FIG. 18 has two first rear face finger portions 327 and two second rear face finger portions 325.

The two second rear face finger portions 327 are the same as those described in the embodiment shown in FIG. 17. The second rear face finger portions 325 generally extend downward from the second rear edge 307 of the top face 300 towards the bottom face 330. Each second rear face finger portion 325 can be considered a partial rear face portion because neither finger portion alone extends substantially the entire length of the rear edge and is not solid for that entire length, or alternatively the second rear face can be considered as including an opening or a gap therebetween. One of the second rear face finger portions 325 is adjacent the rear corner 350 of the top face 300 and another of the second rear face finger portions 325 is adjacent the second side corner 354 of the top face 300, though it is to be understood that the second rear face finger portions can be positioned anywhere between the rear corner 350 and the second side corner 354. Put another way, there is generally an opening in the second rear face between the second rear face finger portions, or the second rear face is not completely solid. The second rear face finger portions 325 can be connected to one another by a rear face finger connector portion as explained above.

The first rear face finger portions 327 generally extend downward from the first rear edge 306 of the top face 300 towards the bottom face 330. Each first rear face finger portion 327 can be considered a partial rear face portion because neither finger portion alone extends substantially the entire length of the rear edge and is not solid for that entire length, or alternatively the first rear face can be considered as including an opening or a gap therebetween. One of the first rear face finger portions 327 is adjacent the rear corner 350 of the top face 300 and another of the first rear face finger portions 327 is adjacent the first side corner 352 of the top face 300, though it is to be understood that the first rear face finger portions can be positioned anywhere between the rear corner 350 and the first side corner 352. Put another way, there is generally an opening in the first rear face between the first rear face finger portions, or the first rear face is not completely solid. The first rear face finger portions 327 can be connected to one another by a rear face finger connector portion as explained above.

It should be understood that the first rear face 324 and second rear face 326 can be formed from as many finger portions as is desired and that such finger portions may be of any suitable size, shape, and configuration. In this regard, each finger portion can have an aperture along bottom or top edges thereof. The apertures can be dimensioned and spaced in any manner desired, such as has already been explained with regard to the aperture 322 of the rear face 320. The aperture 322 of the finger portion of the rear face 320 can be aligned with a bottom face aperture 332, such as is shown in FIG. 16, so that a common fastener can pass through both apertures (e.g. proximate 332), or they can be independent of each other (e.g. proximate 322).

The novel and useful tamper-resistant end caps, couplers, and corner pieces described herein are particularly advantageous. For example, the presently disclosed devices improve greatly upon existing devices by protecting the associated baseboard heater cover panels from damage while also providing a tamper-resistant cover. This allows for less need to continually replace covers, thereby leading to efficiency and safety.

The present disclosure overcomes the aforementioned disadvantages with a cost-effective, easy-to-use tamper-resistant system that is capable of being easily adapted for use with baseboard heaters, air vents, and the like and is further capable of withstanding attempts to tamper with or remove the components thereof. It is more specifically contemplated that the presently disclosed corner piece can be used in a corner or other turn to mate associated cover pieces, especially in applications where it is desirable to minimize the ability to remove or tamper with the cover pieces or baseboard heater. Similarly, the presently disclosed coupler can be used to mate associated cover pieces, and the presently disclosed end cap can be used to provide an aesthetically pleasant piece at the end of a cover panel. Generally, the end cap and coupler contain additional security features, such as apertures that permit them to be placed for use on a baseboard heating unit, and then be secured to the wall to deter tampering with the heating unit.

The presently disclosed end caps, couplers, and corner pieces can be easily adapted to meet the needs of any project. As such, there is no inherent limit on their size, shape, or length, or the material from which they can be composed or the items they can be used to cover. In preferred embodiments, any one or more of the end cap, coupler, and corner piece are made from steel, specifically galvanized steel and preferably at least 22 gauge steel. Any one or more of the end cap, coupler, and corner piece can be power coated or painted to a desired color and to resist rusting of the steel.

The present system can be quickly and easily installed by sliding associated heater cover panels through the open side faces, which cover panels may be secured using one or more retainers. Associated fasteners may then be passed through the one or more apertures of the rear face(s) to secure the cover to a wall.

Also particularly disclosed herein are the following embodiments of corner pieces:

Embodiment 1: A corner piece for a baseboard heating unit, comprising: a top face having a front edge, a first side edge, a second side edge, a first rear edge, and a second rear edge; a front face extending downwardly from the front edge of the top face; at least one rear face extending downwardly from the first or second rear edge of the top face; a bottom face extending from a bottom edge of the front face; and a first open side face and a second open side face, each adapted to receive a portion of an associated cover piece; wherein either (a) the at least one rear face has at least one rear face aperture along a bottom edge thereof that can accommodate an associated fastener for attachment to a wall; or (b) the bottom face has a lip extending downwardly from a distal edge thereof, the lip having at least one lip aperture that can accommodate an associated fastener for attachment to a wall.

Embodiment 2: The corner piece of Embodiment 1, wherein the bottom face has a generally L-shaped cross section.

Embodiment 3: The corner piece of any of Embodiments 1-2, wherein the bottom face has first and second leg portions extending from the bottom edge of the front face at an angle relative to one another.

Embodiment 4: The corner piece of Embodiment 3, wherein the angle between the first and second leg portions, measured from inner edges of the first and second leg portions, is from about 45° to about 135°.

Embodiment 5: The corner piece of any of Embodiments 3-4, wherein the first and second leg portions each have a lip extending downwardly from a distal edge thereof, the lip having at least one lip aperture that can accommodate an associated fastener for attachment to a wall.

Embodiment 6: The corner piece of any of Embodiments 1-5, wherein the bottom face has at least one retainer adapted to secure associated cover pieces to the corner piece.

Embodiment 7: The corner piece of any of Embodiments 1-6, wherein the at least one rear face includes a full face extending downwardly from the first rear edge of the top face and a partial face extending downwardly from the second rear edge of the top face.

Embodiment 8: The corner piece of any of Embodiments 1-7, wherein the at least one rear face includes a first partial face extending downwardly from the first rear edge of the top face and a second partial face extending downwardly from the second rear edge of the top face.

Embodiment 9: The corner piece of any of Embodiments 1-8, wherein both (a) the at least one rear face has at least one rear face aperture along a bottom edge thereof that can accommodate an associated fastener for attachment to a wall; and (b) the bottom face has a lip extending downwardly from a distal edge thereof, the lip having at least one lip aperture that can accommodate an associated fastener for attachment to a wall.

Embodiment 10: The corner piece of Embodiment 9, wherein the at least one rear face aperture is aligned with the at least one lip aperture.

Embodiment 11: The corner piece of any of Embodiments 9-10, wherein the bottom face has (a) a first leg portion extending rearwards from the bottom edge of the front face towards a first rear face; and (b) a second leg portion extending rearwards from the bottom edge of the front face towards a second rear face, each leg portion having a lip extending downwardly from a distal edge thereof with at least one lip aperture that can accommodate an associated fastener for attachment to a wall.

Embodiment 12: The corner piece of Embodiment 11, wherein the second rear face is a partial rear face adjacent a rear corner, such that the at least one rear face aperture of the second rear face is not aligned with the at least one lip aperture of the second leg portion.

Embodiment 13: The corner piece of any of Embodiments 11-12, wherein the first rear face is a full rear face having at least a first rear face aperture and a second rear aperture, wherein the first rear aperture is aligned with the at least one lip aperture of the first leg portion and the second rear aperture is independent from the at least one lip aperture of the first leg portion.

Embodiment 14: The corner piece of any of Embodiments 11-13, wherein the first rear face and the second rear face are each a full rear face having at least a first rear face aperture and a second rear aperture, wherein the first rear aperture of each rear face is aligned with the at least one lip aperture of one leg portion of the bottom face and the second rear aperture is independent from the at least one lip aperture of the one leg portion.

Embodiment 15: The corner piece of any of Embodiments 1-14, wherein the bottom face is a full bottom face having a first rear edge and a second rear edge, each rear edge having a lip extending downwardly thereof with at least one lip aperture that can accommodate an associated fastener for attachment to a wall; wherein the at least one rear face includes a first rear face extending downwardly from the first rear edge of the top face and a second rear face extending downwardly from the second rear edge of the top face; wherein a rear face aperture of the first rear face is aligned with the at least one lip aperture on the lip on the first rear edge of the bottom face; and wherein a rear face aperture of the second rear face is aligned with the at least one lip aperture on the lip on the second rear edge of the bottom face.

Embodiment 16: The corner piece of any of Embodiments 1-15, wherein the front face comprises an angled upper surface and vertical lower surface.

Embodiment 17: The corner piece of any of Embodiments 1-16, wherein the front edge of the top face is angled relative to the first and second side edges approximately 135°.

Embodiment 18: The corner piece of any of Embodiments 1-17, wherein the at least one rear face is formed from at least two finger portions extending downwardly from the first or second rear edge of the top face.

Embodiment 19: The corner piece of Embodiment 18, wherein a rear face finger portion connector interconnects the at least two finger portions of the at least one rear face.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A corner piece for a heater cover assembly, comprising:

a top face having a front edge, a first side edge, a second side edge, a first rear edge, and a second rear edge;

a front face extending downwardly from the front edge of the top face;

a bottom face extending from a bottom edge of the front face, the bottom face having a lip at a distal edge with at least one lip aperture therein;

a first rear face extending downwardly from the first rear edge of the top face and having a bottom edge with at least one rear face aperture therein;

a second rear face extending downwardly from the second rear edge of the top face and having a bottom edge with at least one rear face aperture therein; and a first open side face and a second open side face, each open side face adapted to accommodate an associated heater cover panel;

wherein the first rear face comprises two finger portions and the second rear face comprises one or two finger portions, each finger portion having a rear face aperture;

wherein a rear face finger portion connector connects the two finger portions of the first rear face proximate the top face; and wherein the at least one lip aperture of the bottom face is aligned with the at least one rear face aperture of the first rear face.

2. The corner piece of claim 1, wherein the bottom face comprises a first leg portion and a second leg portion extending from the bottom edge of the front face, each leg portion having a lip at a distal end with at least one lip aperture therein.

3. The corner piece of claim 1, wherein the front face includes an angled upper surface and a vertical lower surface.

4. The corner piece of claim 1, wherein the bottom face includes at least one retainer for securing an associated heater cover panel.

5. The corner piece of claim 1, wherein the bottom face is a full bottom face.

6. A corner piece for a baseboard heating unit, comprising:

a top face having a front edge, a first side edge, a second side edge, a first rear edge, and a second rear edge;

a front face extending downwardly from the front edge of the top face;

at least one rear face extending downwardly from the first or second rear edge of the top face;

a bottom face extending from a bottom edge of the front face; and a first open side face and a second open side face, each adapted to receive a portion of an associated cover piece;

wherein both (a) the at least one rear face has at least one rear face aperture along a bottom edge thereof that can accommodate an associated fastener for attachment to a wall; and (b) the bottom face has a lip extending downwardly from a distal edge thereof, the lip having at least one lip aperture that can accommodate an associated fastener for attachment to a wall; and wherein the at least one rear face aperture is aligned with the at least one lip aperture.

7. The corner piece of claim 6, wherein the bottom face has first and second leg portions extending from the bottom edge of the front face at an angle relative to one another; and wherein the first and second leg portions each have a lip extending downwardly from a distal edge thereof, the lip having at least one lip aperture that can accommodate an associated fastener for attachment to a wall.

8. The corner piece of claim 6, wherein the bottom face has (a) a first leg portion extending rearwards from the bottom edge of the front face towards a first rear face; and (b) a second leg portion extending rearwards from the bottom edge of the front face towards a second rear face, each leg portion having a lip extending downwardly from a distal edge thereof with at least one lip aperture that can accommodate an associated fastener for attachment to a wall.

9. The corner piece of claim 8, wherein the second rear face is a partial rear face adjacent a rear corner, such that the at least one rear face aperture of the second rear face is not aligned with the at least one lip aperture of the second leg portion.

10. A corner piece for a baseboard heating unit, comprising:

a top face having a perimeter formed from a front edge, a first side edge, a second side edge, a first rear edge, and a second rear edge;

a front face extending downwardly from the front edge of the top face, wherein the front face includes an angled upper surface and a vertical lower surface;

a bottom face comprising a first leg portion and a second leg portion extending from the bottom edge of the front face, each leg portion having a lip at a distal end with at least one lip aperture therein, and wherein the bottom face includes at least one retainer for securing an associated heater cover panel;

a first rear face comprising two finger portions extending downwardly from the first rear edge of the top face, each finger portion having a bottom edge with at least one rear face aperture therein;

a second rear face comprising a single finger portion extending downwardly from the second rear edge of the top face having a bottom edge with at least one rear face aperture therein; and a first open side face and a second open side face, each open side face adapted to accommodate an associated heater cover panel; and wherein the at least one lip aperture of the first leg portion of the bottom face is aligned with the at least one rear face aperture of the first rear face.

* * * * *